US011708251B2

(12) United States Patent
Nooren et al.

(10) Patent No.: US 11,708,251 B2
(45) Date of Patent: Jul. 25, 2023

(54) LIFT SYSTEM FOR HEAVY OVERSIZED STRUCTURAL ELEMENT

(71) Applicant: Mammoet USA South, Inc., Rosharon, TX (US)

(72) Inventors: Piet Nooren, Angleton, TX (US); Jack L. Tol, Manvel, TX (US)

(73) Assignee: MAMMOET USA SOUTH, INC., Rosharon, TX (US)

( * ) Notice: Subject to any disclaimer, the term of this patent is extended or adjusted under 35 U.S.C. 154(b) by 0 days.

(21) Appl. No.: 16/891,490

(22) Filed: Jun. 3, 2020

(65) Prior Publication Data

US 2021/0380379 A1 Dec. 9, 2021

(51) Int. Cl.
*B66F 3/25* (2006.01)

(52) U.S. Cl.
CPC ..... *B66F 3/25* (2013.01)

(58) Field of Classification Search
CPC ..... B66F 3/25; B66F 5/00; B66F 5/02; B66F 7/14; B66F 7/16; B66F 7/20; B66F 7/28; B66F 9/00; B66F 9/07; B66F 9/08; B66F 9/20
USPC ..... 254/3 C, 4 R, 5 C, 8 R, 10 C, 424, 425, 254/93 R; 269/17
See application file for complete search history.

(56) References Cited

U.S. PATENT DOCUMENTS 4,697,977 A * 10/1987 Loomer ..... B66F 9/07 414/662
4,999,902 A * 3/1991 Schumacher ..... B66F 9/07563 187/238
5,509,502 A * 4/1996 Beaulieu ..... E04H 12/10 187/242
6,193,219 B1 * 2/2001 Belley ..... B66F 7/20 254/89 R (Continued)

FOREIGN PATENT DOCUMENTS

CA 2466983 A1 * 11/2005 ..... B66F 11/04
CN 103964300 A * 8/2014

(Continued)

OTHER PUBLICATIONS

International Search Report dated Sep. 14, 2021 and issued in counterpart International PCT Application No. PCT/US2021/034348.

(Continued)

*Primary Examiner* — Don M Anderson
*Assistant Examiner* — Jonathan R Zaworski
(74) *Attorney, Agent, or Firm* — Cabello Hall Zinda, PLLC

(57) ABSTRACT

A system is used for lifting a heavy oversized structural element. At least two opposing lifts are placement adjacent opposing sides of the element. Each lift includes a base, a tower, an elevator, and an actuator. The tower extending vertically from the base, and the elevator is disposed on the tower. A support extends from the elevator outward from the (Continued)

tower to engage a point on the element. A guide of the elevator is configured to ride along a rail of the tower. The actuator is connected to the elevator and is configured to move with the elevator vertically along the tower. The actuator can include a strand jack disposed on the elevator. Hydraulic operation of the stand jack moves the jack and elevator along a strand extending along the tower. The arrangements of the lifts leave space below the raised element free for access to other operations.

24 Claims, 22 Drawing Sheets

(56) References Cited

U.S. PATENT DOCUMENTS

| | | | | |
|---|---|---|---|---|
| 6,368,022 | B1 * | 4/2002 | Zingerman | E04G 21/163 405/230 |
| 8,056,681 | B2 * | 11/2011 | Fukuda | B66F 9/07 187/244 |
| 8,083,034 | B2 * | 12/2011 | Bordwell | B66F 7/20 187/210 |
| 8,579,304 | B2 * | 11/2013 | Setzer, Sr. | B66F 17/003 280/47.17 |
| 9,222,277 | B2 * | 12/2015 | Yustus | E04H 12/344 |
| 9,249,000 | B2 * | 2/2016 | Finkbeiner | B66F 3/24 |
| 9,696,029 | B2 * | 7/2017 | Boecker | F22B 37/24 |
| 9,764,934 | B2 * | 9/2017 | Knapp | B66F 7/28 |
| 9,834,411 | B2 * | 12/2017 | Cox | B66B 9/025 |
| 10,144,625 | B2 * | 12/2018 | Giattina | B66F 3/24 |
| 10,183,838 | B2 * | 1/2019 | Weber | B66B 19/00 |
| 10,472,095 | B1 * | 11/2019 | Vance | B25J 5/007 |
| 2002/0017637 | A1 * | 2/2002 | Belley | E02F 9/003 254/89 H |
| 2006/0213145 | A1 | 9/2006 | Haller | |
| 2013/0209203 | A1 * | 8/2013 | Rafols | B66F 9/07 414/666 |
| 2014/0193255 | A1 | 7/2014 | Hancock et al. | |

FOREIGN PATENT DOCUMENTS

| | | | | |
|---|---|---|---|---|
| CN | 105980699 | B | | 8/2019 |
| CN | 110482434 | A | * | 11/2019 |
| EP | 3219983 | A1 | | 9/2014 |
| EP | 2939933 | A1 | | 11/2015 |
| EP | 1558464 | B1 | | 8/2018 |
| EP | 3090171 | B1 | | 4/2019 |
| EP | 3620393 | A1 | | 11/2020 |
| JP | 4913847 | A | | 2/1974 |
| JP | H05311762 | A | * | 11/1993 |
| KR | 101153779 | B1 | * | 6/2012 |
| KR | 20150069988 | A | * | 5/2014 |
| PL | 219574 | B1 | * | 5/2015 |
| WO | 98/52860 | A1 | | 11/1998 |
| WO | 2014/186868 | A1 | | 11/2014 |

OTHER PUBLICATIONS

"ALE Deploys Mega Jack 300 in Kuwait." Heavy Lift & Project Forwarding International Magazine, Oct. 24, 2018. www.ale-heavylift.com (http://www.ale-heavylift.com).

"ALE Expands Mega Jack 300 Fleet and Capabilities in Europe." Crane Network News, Nov. 19, 2018. https://cranenetworknews.com/ale-expands-mega-jack-300-fleet-and-capabililties-in-europe/.

"ALE Increasing Jacking Capacity to Over 100,000T." Breakbulk.news. Feb. 15, 2018. https://breakbulk.new/ale-increase-jacking-capacity-100000t/.

Mammoet, "SSL30 Strand Jack, Lifting Block Dimensions and Specifications." Version 1, Nov. 6, 2015, SAP No. 4000116254.

Dorman Long Technology Limited. "DL-P40 Release 3.029.xx Computer Control System." Operation and Maintenance Manual. v3, rev. 3.029, pp. 1-54.

ALE, "Equipment Data Sheet—500te Climbing Jack." Issue 1. www.ale-heavylift.com. https://www.ale-heavylift.com_wp-content_uploads_2014_01_Equipment-Data-Sheet-500te-Climbing-Jack.pdf.

ALE, "Equipment Data Sheet—Mega Jack System MJS5200." Issue 1. www.ale-heavylift.com. https://www.ale-heavylift.com_wp-content_uploads_2014_01_Equipment-Data-Sheet-Mega-Jack-System.pdf.

ALE, "Equipment Data Sheet—500te Screwed Locking Collar Jack." Issue 1. www.ale-heavylift.com. https://www.ale-heavylift.com_wp-content_uploads_2014_01_Equipment-Data-Sheet-SLT-Jacks.pdf.

ALE, "ALE Mega Jack 300 System." www.ale-heavylift.com. https://www.ale-heavylift.com_wp-content_uploads_2018_03_Data-Sheet.pdf.

Doorman Long Technology, "Strand Jack Systems, Stand jacks, power packs and control systems," V2.0, pp. 1-24, undated, downloaded from www.dormanlongtechnology.com May 4, 2021.

Doorman Long Technology, "DL-TLG200 Telescopic Lifting Gantry," undated, downloaded from www.dormanlongtechnology.com on May 4, 2021, 6-pgs.

Doorman Long Technology, "DL-TLG400 Telescopic Lifting Gantry," undated, downloaded from www.dormanlongtechnology.com on May 4, 2021, 7-pgs.

Doorman Long Technology, "DL-TLG600 Telescopic Lifting Gantry," undated, downloaded from www.dormanlongtechnology.com on May 4, 2021, 7-pgs.

Doorman Long Technology, "DL-TLG1200 Telescopic Lifting Gantry," undated, downloaded from www.dormanlongtechnology.com on May 4, 2021, 7-pgs.

Doorman Long Technology, "Pinned Climbing & Skidding Jacks, Hydraulic Power Units and Control Systems," undated, downloaded from www.dormanlongtechnology.com on Sep. 28, 2022, 20-pgs.

* cited by examiner

100

LIFT SYSTEM FOR HEAVY OVERSIZED STRUCTURAL ELEMENT

BACKGROUND OF THE DISCLOSURE

Various types of equipment can be used to lift extremely heavy loads. Lifting can be done using boom cranes, gantry cranes, and jack-up systems.

For example, boom cranes can be used to lift modules for installation at an elevation on a site's foundation. In this example, a boom crane can lift modules onto transports for transport to a worksite. Then, at the worksite, a boom crane can lift the modules from the transports for direct placement of the modules on the site's foundation. Alternatively, the modules can be assembled at the worksite, and a boom crane can lift the modules directly onto the site's foundation.

Other than boom cranes, gantry cranes can be placed on site at a fixed location to lift modules from above. Trailers can transport a module from a fabrication location to the lift location. The gantry crane can lift the module to a height. Trailers with raised falsework can then be rolled under the lifted module, and the module can be lowered on the trailers for transporting the modules for installation.

Cranes may also be used to lift and stack a top module onto a bottom other. With a gantry crane, for example, trailers can drive a bottom module under the gantry crane, which then lifts the bottom module. The trailers are removed to have raised falsework placed on them. The trailers with the raised falsework are then rolled under the elevated bottom module. After loading, the trailers move the bottom module away from the gantry crane and place the bottom module on temporary stands, which will allow the trailers to be removed. Then, the trailers move the top module under the gantry crane, which lifts the top module. At this point, the trailers reposition under the bottom module and then roll the bottom module under the top module. The two modules are mated, and the trailers then transport the modules to the site's foundation to set the stacked modules.

Rather than using cranes, all of the modules can instead be built at the site at the required elevation so the modules do not need to be lifted. To install an assembled module in this instance, trailers can be rolled under the elevated module to pick up the load. The trailers can then transport the modules directly to the site to place the modules on columns at the site's foundation.

Other than cranes, jack-up systems can be used to lift modules at the worksite. For example, a climbing jack has a piston supported on stacked falsework (e.g., timbers). The piston is activated to raise the load, and new timbers are packed around the sides of the piston. When the piston is retracted, the jack rests on the side timbers, and center timbers are inserted under the retracted piston. This process is repeated in stages to lift the load.

Another jack up arrangement pushes up the load using a set of four jacks. Parallel jacking beams are fed to the four jack in an alternating arrangement and are successively lifted to raise the load. This system can be used for lifting pipe rack modules and the like. Yet other jack up arrangements use a jacking base to lift successively fed cassettes to raise (jack up) the load.

Such jack-up arrangements can be used at a worksite to lift a pipe rack module so the module will be lifted to an elevation for the project's foundation, such as support columns. For example, the module may be built at the site on load spreaders that are about 1.5 m off the ground. Once the module is assembled, trailers are driven under the module, and lifts on the trailers are used to raise the module to a height of about 2 m of height. The load spreaders are removed, and the jack up system is placed under each leg of the module to take up the load from the lifts on the trailers and jack-up the load to a desired elevation.

Although such crane and jack-up arrangements are useful, they require the installation and transport of multiple components to lift the load. Moreover, jack-up systems require a number of components to be situated substantially under the load, which takes up space for other equipment and operations.

The subject matter of the present disclosure is directed to overcoming, or at least reducing the effects of, one or more of the problems set forth above.

SUMMARY OF THE DISCLOSURE

As disclosed herein, a system is used for lifting a heavy oversized load, which can include, but is not limited to a structure or structural element (e.g., a Floating Production Storage and Offloading (FPSO) module, a pipe rack module, a bridge component), equipment or equipment component (e.g., a ship, a processing vessel, a reactor drum, a transformer skid, a shovel used in mining industry), or any other very heavy and large load weighing tens to hundreds of tons having at least two opposing sides. The system comprises at least two opposing lifts for placement adjacent the at least two opposing sides of the load. Each of the lifts comprises a base, a tower, an elevator, and an actuator. The tower extends vertically from the base and has a first guide disposed therealong.

The elevator is disposed on the tower and has a support and a second guide. The support extends from the elevator outward from the tower and is configured to support a portion adjacent the one of the at least two opposing sides of the load. The second guide of the elevator is configured to ride along the first guide of the tower. The actuator is connected to the elevator and is configured to move the elevator vertically along the tower.

The actuator can comprise a strand jack disposed on the elevator, a strand jack disposed on the tower, a motor disposed on the tower and using a worm gear and a screw bearing, a motor disposed on the elevator and using a worm gear and a screw bearing, one or more linear hydraulic pistons disposed between the elevator and the tower, or a push-pull jack disposed on the elevator.

As disclosed herein, a lift is used for lifting a heavy oversized load that has at least two opposing sides. The lift comprises a base, a tower, an elevator, a strand of cables, and a strand jack. The base can be placed adjacent one of the at least two opposing sides of the load. The tower extends vertically from the base and has a first guide disposed therealong.

The elevator is disposed on the tower and has a support and a second guide. The support extends from the elevator outward from the tower and is configured to support a portion adjacent the one of the at least two opposing sides of the load. The second guide of the elevator is configured to ride along the first guide of the tower. The strand of cables extends along the tower. The strand jack is disposed on the elevator and is configured to move the elevator vertically along the strand of cables.

A system for lifting a heavy oversized load can comprise a plurality of the above lifts for arrangement along the at least two opposing sides of the load.

In a method used for a heavy oversized load having at least two opposing sides, a plurality of lifts are arranged along the at least two opposing sides. The load is supported at points along the at least two opposing sides by engaging supports of the lifts at the points and leaving a space under the load free. The oversized load is then lifted relative to the free space under the load by operating each of the lifts arranged along the at least two opposing sides.

At any point, an operation can be performed in the free space under the load because the lifts are arranged about the at least two opposing sides of the structure. For example, the load can be lifted from at least one mobile transport. The at least one mobile transport can then be removed from under the load. At this point, at least one component can be arranged on the same or different mobile transport(s), which can be moved back under the lifted load, so the load can be lowered onto the at least one supported component on the mobile transport(s). Alternatively, once the mobile transport (s) are removed from the lifted element, a plurality of support members can be arranged under the load, which can then be lowered onto the support members.

The foregoing summary is not intended to summarize each potential embodiment or every aspect of the present disclosure.

DETAILED DESCRIPTION OF THE DISCLOSURE

Figure 1B:
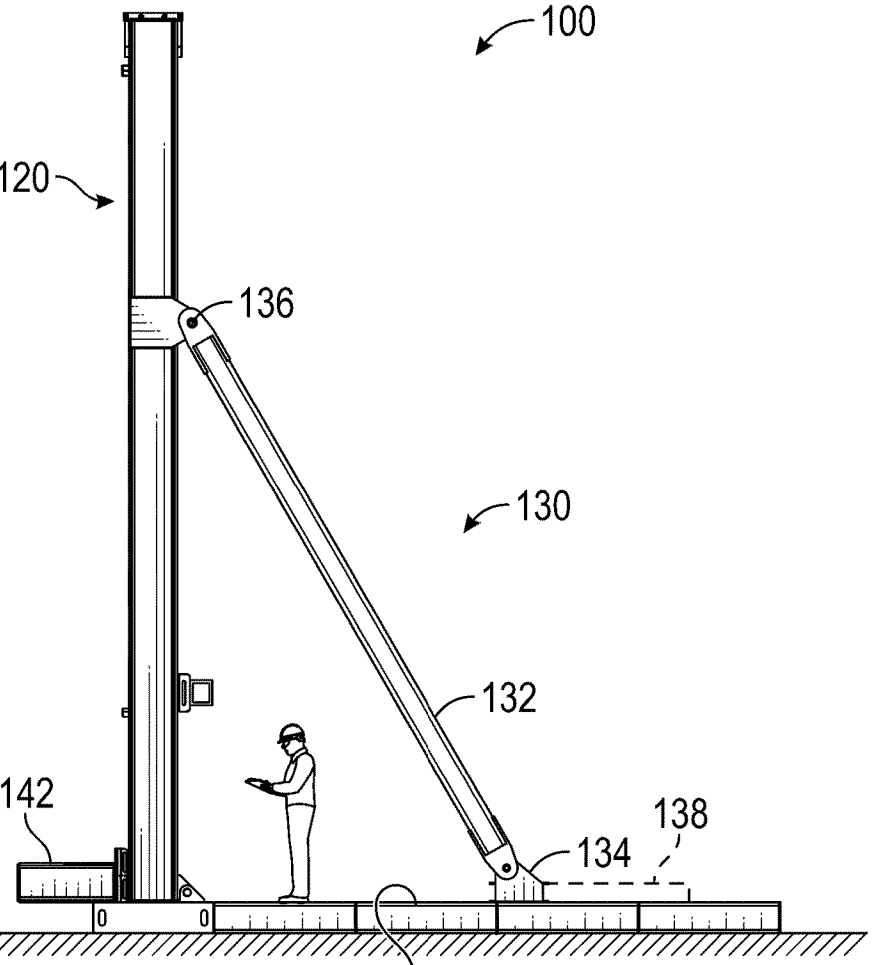
FIG. 1B illustrates a side elevational view of the disclosed lift.
Figure 1A:
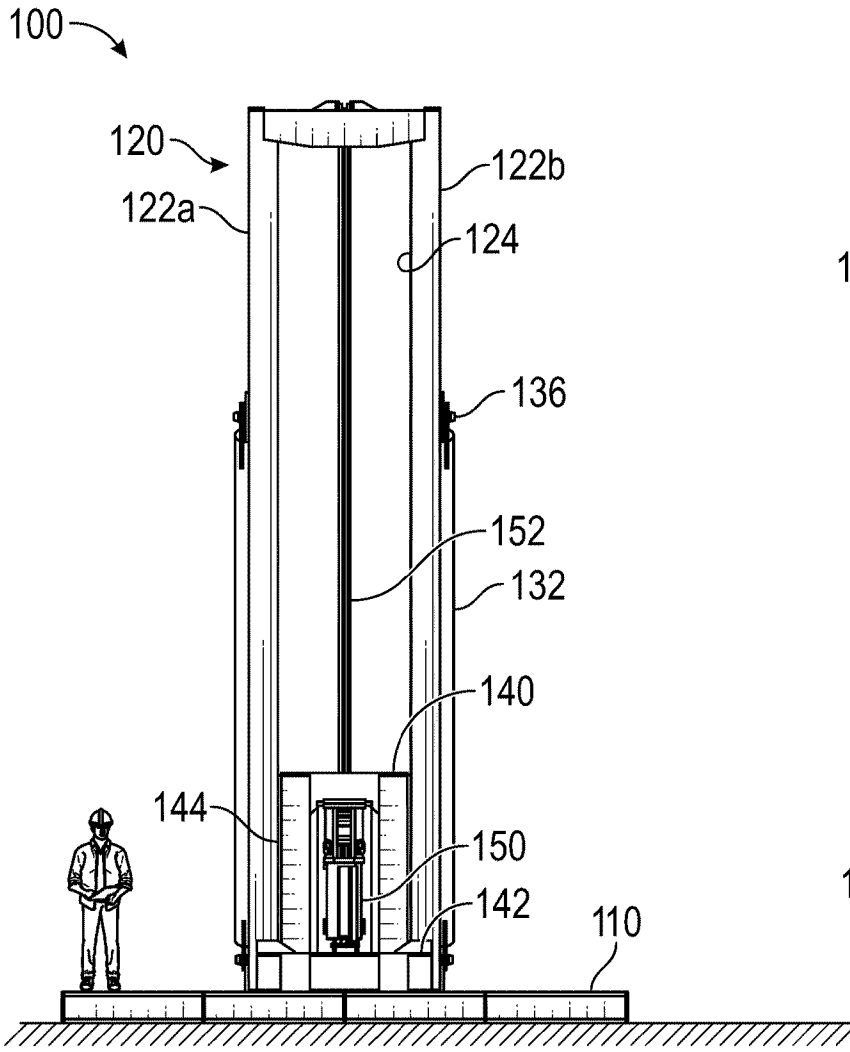
FIG. 1A illustrates a front elevational view of a lift according to the present disclosure.

A lift and a lift system having lifts according to the present disclosure are used for lifting (raising/lowering) very heavy and large loads, which can include, but are not limited to structures or structural elements (e.g., a Floating Production Storage and Offloading (FPSO) module, a pipe rack module, a bridge component, etc.), equipment or equipment components (e.g., a ship, a processing vessel, a reactor drum, a transformer skid, a shovel used in mining industry, etc.), or any other very heavy and large load weighing tens to hundreds of tons. (As disclosed herein, the terms "load", "structural element", "module," and the like may be used interchangeably.) As typical, such structures, elements, equipment, loads, and the like may be pre-assembled at one location and then transported to another location for installation at a site. For example, a structural element, such as a pipe rack module, is typically constructed at one location and is then transported by boat, barges, and other transport to a site for integration into a site's foundation or for integration with other modules. The lifts and lift system disclosed herein can lift such loads and structural elements from ground level or elsewhere so transports can be moved under the lifted element, which can then be lowered onto the transports. Additionally, the lifts and lift system disclosed herein can lift such a load or structural element from transports so the transports can be removed under the lifted element, which can then be lowered to ground level or elsewhere.

In construction of refineries, processing plants, and other such projects, for example, a pipe rack module is assembled at a location away from a construction site, and the pre-assembled module is then delivered by a vessel or barges to the project's construction dock. Dock cranes can be used to move the module from the vessel to mobile transports, such as Self-Propelled Mobile Transports (SPMTs) used for transporting very large and heavy loads. The module is subsequently transported on the mobile transports to a staging area for integration with other structural elements for the project and/or for installing at the site's foundation. The lifts and lift system disclosed herein can lift such structural elements, modules, and the like in ways not available with conventional jack-up systems.

FIGS. 1A-1D illustrate a lift 100 according to the present disclosure in various views. The lift 100 is used with other lifts 100 for lifting a heavy oversized load. As noted previously, the load can include a structure (e.g., bridge component, etc.), a structural element (e.g., an FPSO module, a pipe rack module, etc.), equipment or component thereof (e.g., a vessel, a reactor drum, a transformer skid, a shovel used in mining, etc.), or any other very heavy and large load. The lift 100 includes a base 110, a tower 120, and an elevator 140. The base 110 provides a pad to support the lift 100 at a site and to transfer the load to the ground surface. In use as discussed below, the base 110 is placed to be adjacent one of at least two opposing sides of a load to be lifted.

The tower 120 extends vertically from the base 110. To facilitate transport, the tower 120 can be a separate component from the base 110, and the tower 120 can have a foot that rests on the surface of the base 110. An integrated arrangement can also be used where the tower 120 is hingedly connected to the base 110.

As shown, the tower 120 includes adjacent vertical rails 122*a-b*, which can be beams. A top cross beam can interconnect the top ends of the vertical rails 122*a-b*. A bottom cross beam may also be provided at the bottom of the vertical rails 122*a-b*. Parallel arms 132 of a brace 130 are hingedly connected at hinges 136 to the rails 122*a-b* and extend to a back extent of the base 110. A cross beam 134 at the end of the braces 132 can affix to or engage the base 110. As shown in dashed lines in FIG. 1B and as discussed below, a counterweight 135 placed on the back extent of the base 110 may have the cross beam 134 abut against it.

The tower 120 has a first guide 124 disposed along the vertical rails 122*a-b*, and the elevator 140 is disposed on the tower 120 to ride along the first guide 124. For its part, the elevator 140 has a support 142, an actuator 150, and a second guide 144. The support 142 extends from the elevator 140 outward from the tower 120 and is configured to support a point at the edge of a load. For example, the elevator 140 can include a carriage having the second guide 144 engaged with the first guide 124 of the tower 120, and the support 142 can include forks extending perpendicularly from carriage 140.

The actuator 150 is configured to move the elevator 140 along the tower 120 to lift (raise/lower) the elevator 140 and any load supported by the support 142. In the process, the second rail 144 of the elevator 140 is configured to ride along the first rail 124 of the tower 120.

In one arrangement, the first guide 124 of the tower 120 includes surfaces, faces, or tracks disposed on the adjacent rails 122*a-b*, and the second rail 144 of the elevator 144 includes carriage mounts having rollers that ride in the tower's surfaces, faces, or tracks 124. The rollers can include non-recirculating flat roller bearings in which cylindrical bearing are housed in a cage. Other types of non-recirculating linear bearings can be used, such as those including ball bearings, V-type roller bearings, and cross-roller bearings. Recirculating bearing arrangements can also be used. Moreover, guides in the form of bearing or sliding plates composed of a suitable material (e.g., polytetrafluoroethylene (PTFE) or the like) may also be used instead of rollers.

Figure 1C:
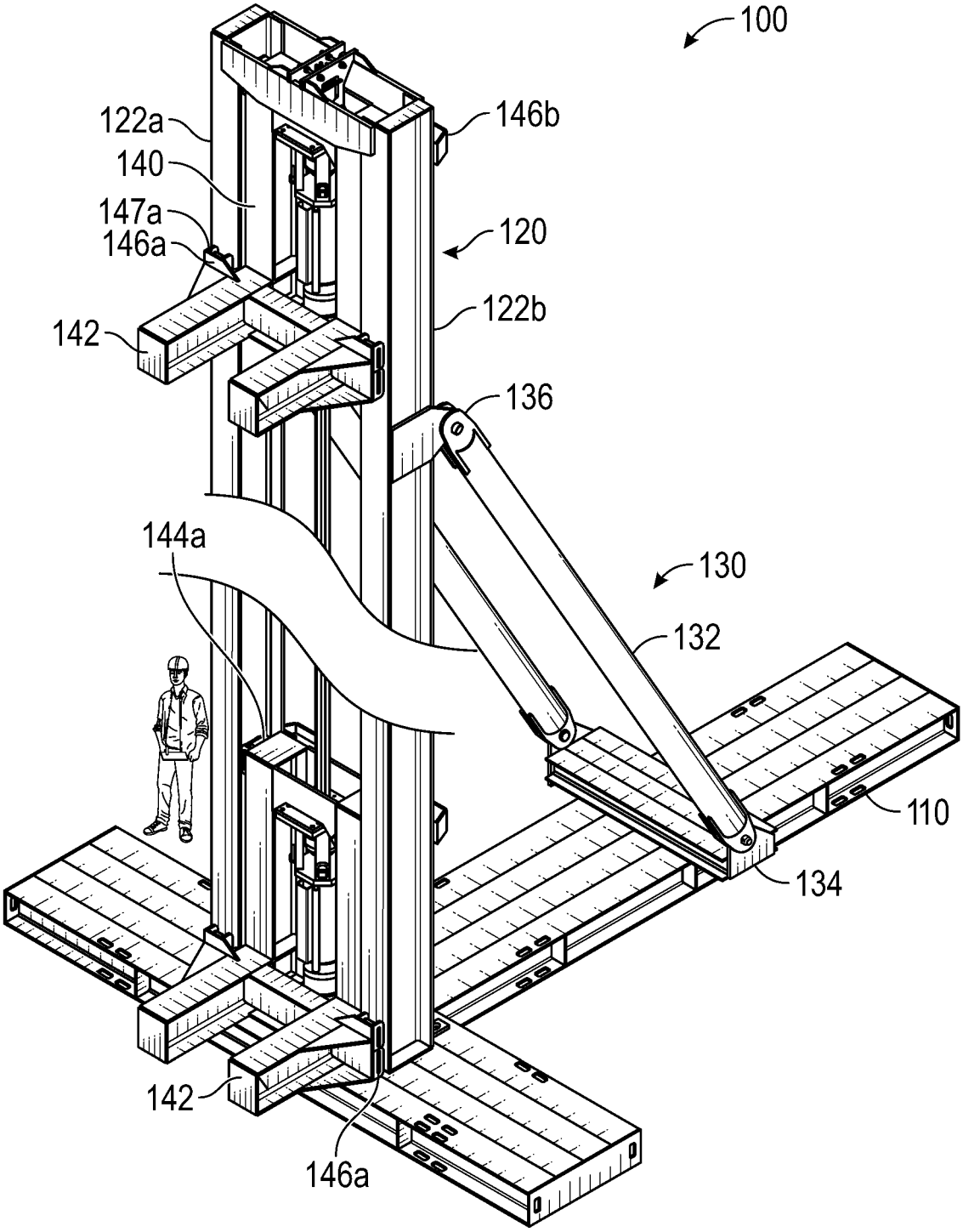
FIG. 1C illustrates a perspective view of the disclosed lift.
Figure 1D:
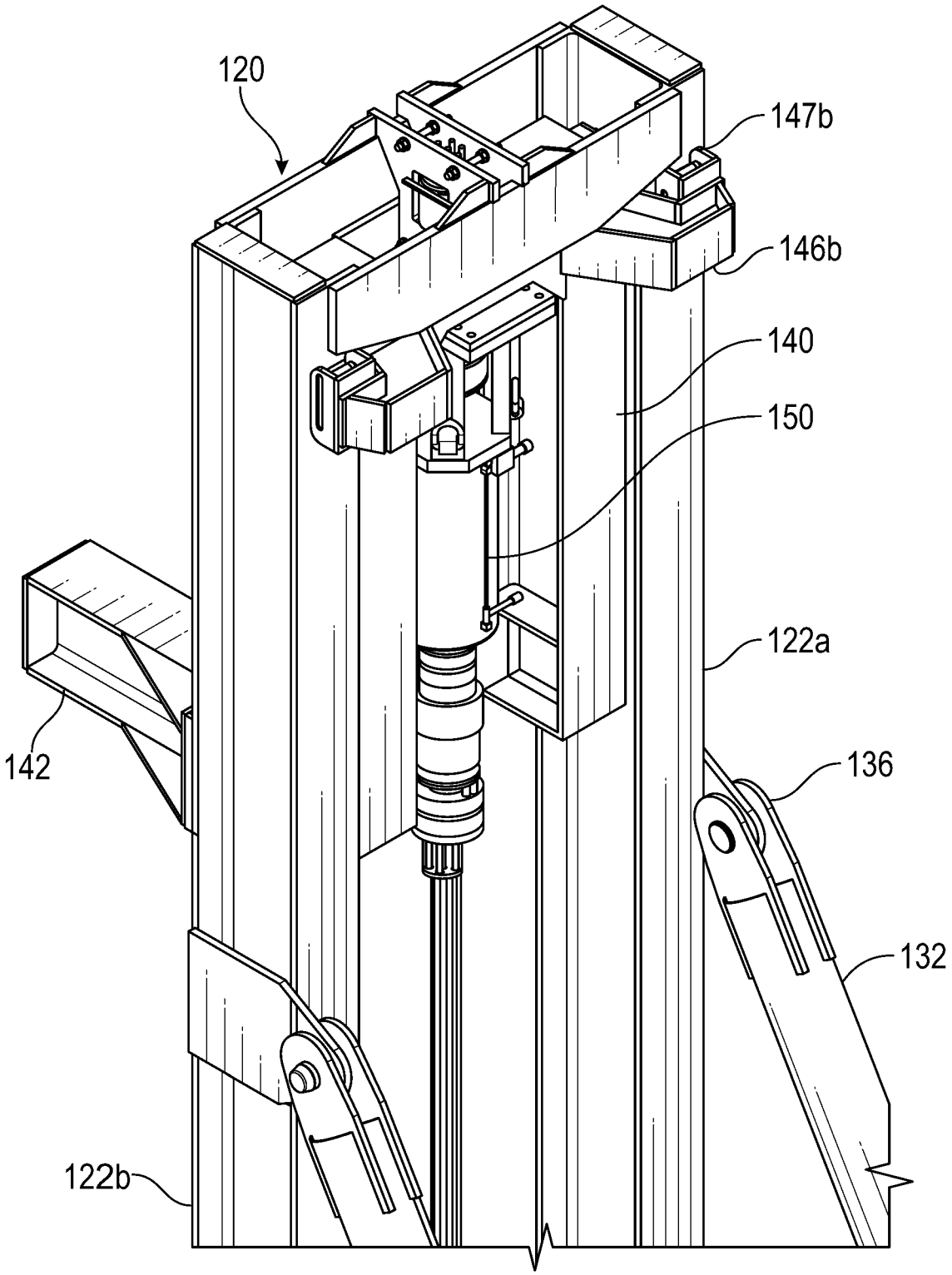
FIG. 1D illustrates another perspective view of a back portion of the disclosed lift.

As best shown in FIGS. 1C-1D, the second guide 144 of the elevator 140 can include: front guides (e.g., rollers, plates) 147*a* disposed on the elevator 140 and engaged with front faces of the adjacent rails 122*a-b*, and back guides (e.g., rollers, plates) 147*b* disposed on the elevator 140 and engaged with the back faces of the adjacent rails 122*a-b*. Front brackets 146*a* toward the bottom of the elevator 140 can hold the front rollers 147*a* that engage a front of the tower's rails 122*a-b*, and back brackets 146*b* toward the top of the elevator 140 can hold the front rollers 147*a* that engage a back of the tower's rails 122*a-b* to support against the cantilevered load on the elevator's supports 142. As only partially visible in FIG. 1C and as discussed in more detail below, the second guide 144 of the elevator 140 can further include side rollers 144*a* disposed on the elevator 140 and engaged with tracks defined along inner faces of the adjacent rails 122*a-b*. The tracks can be recessed along the adjacent rails 122*a-b*.

The actuator 150 is a hydraulic or electric actuator that raises and lowers the elevator 140 while maintaining support of the load. In one arrangement and as shown here, the actuator 150 includes a strand jack disposed on the elevator 140. A strand 152 of cables extend along the tower 120 from the base 110 to a top of the tower 120, and the strand's cables pass through the strand jack 150. Internally, the strand jack 150 has a hydraulic cylinder and piston arranged between upper and lower clamps. The strand jack 150 climbs and descends along the strand 152 by successive clamping and releasing of the upper and lower clamps and successive contracting and expanding of the hydraulic piston between the clamps. Such a strand jack 150 can be finely controlled and can be stopped at any extent on the strand 152 to hold position and the supported load.

Figure 2A:
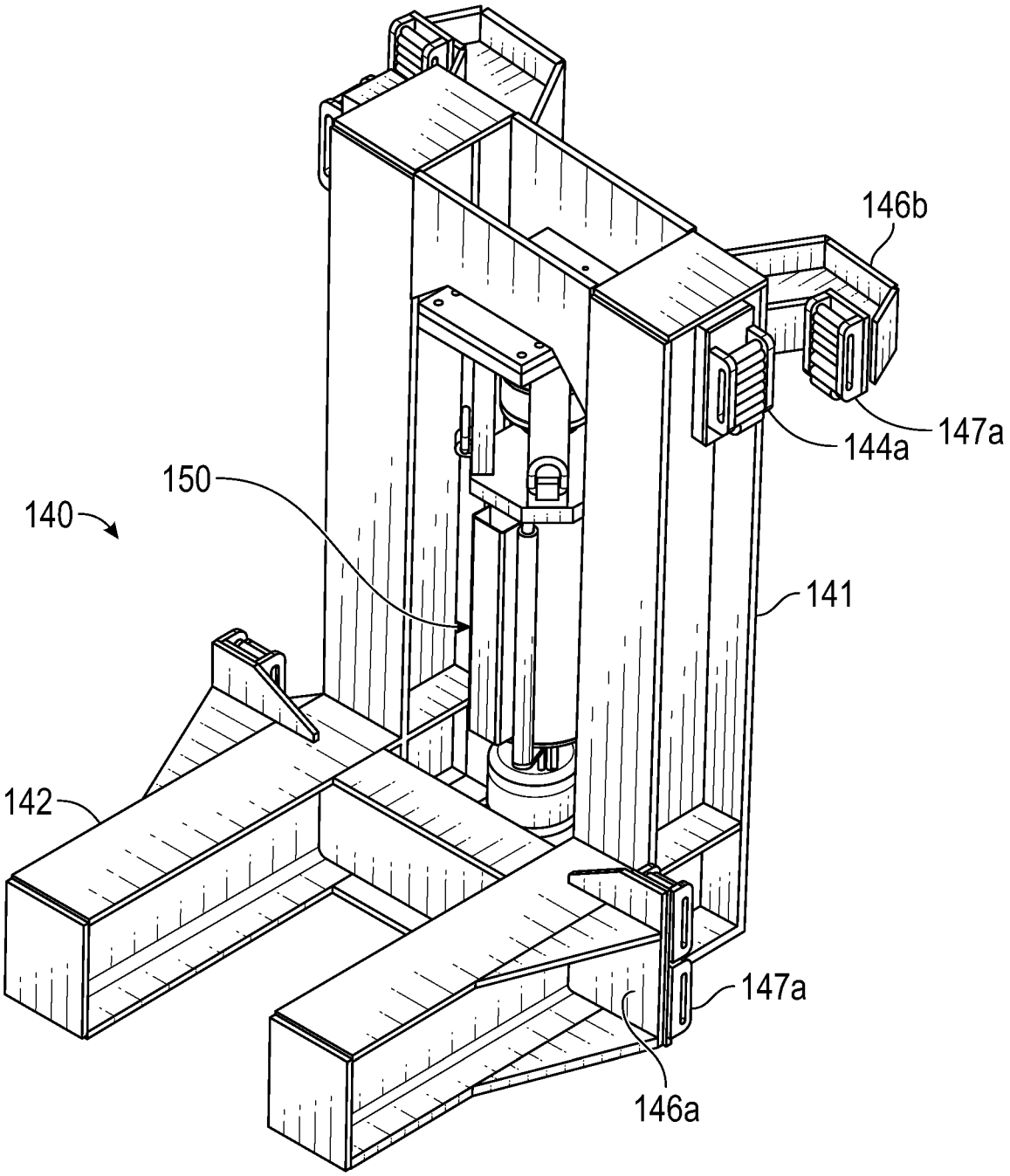
FIG. 2A illustrates a perspective view of an elevator for the disclosed lift.
Figure 2B:
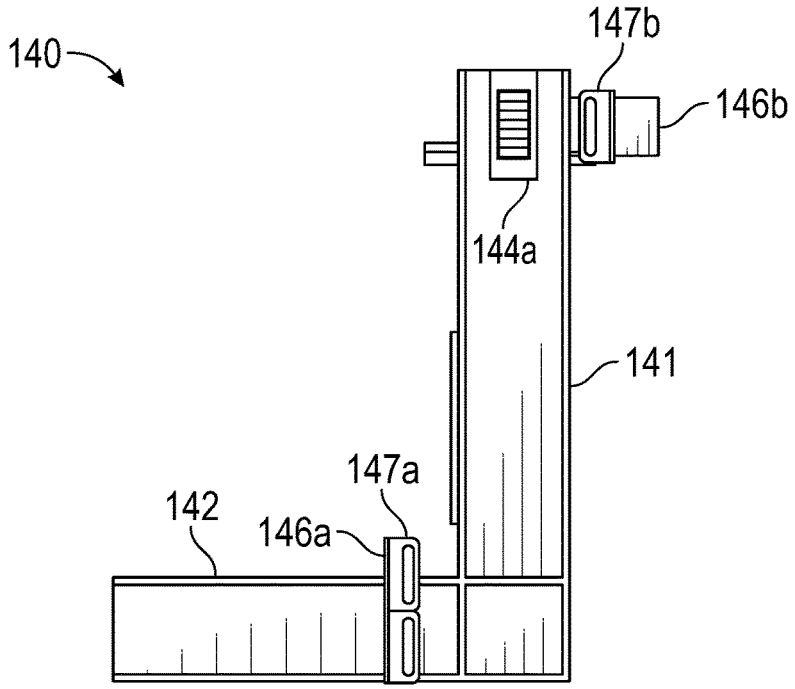
FIG. 2B illustrates a side view of the elevator.

FIGS. 2A-2B illustrate perspective and side views of an elevator 140 for the disclosed lift (100). The elevator 140 includes a carriage frame 141 having a top member, a bottom member, and side members, which can composed of I-beam, box beams, and plates welded together. Supports 142 extend perpendicularly from the bottom of the carriage frame 141 and can also be similarly constructed. As shown, two forks can be used for the supports 142, although other arrangements can be used, such as a platform or the like.

The actuator 150 is supported in the carriage frame 141 at the top and bottom members, which both include central passages for the strands (not shown) to pass. Roller bearings 144 are disposed on upper ends of the side members of the frame 141 and extend outward for riding in the tracks (not shown) of the tower's rails.

Brackets 146*a* toward the bottom member of the frame 141 have roller bearings 147*a* that face backward for engaging against a front face of the tower's vertical rails (122*a-b*). Brackets 146*b* toward the top member of the frame 141 also have roller bearings 147*b*, but these face forward for engaging against a back face of the tower's vertical rails (122*a-b*). These roller bearings 144, 147*a*, and 147*b* include non-recirculating linear bearings, which can be 15-ton Hilman T rollers.

Figure 3:
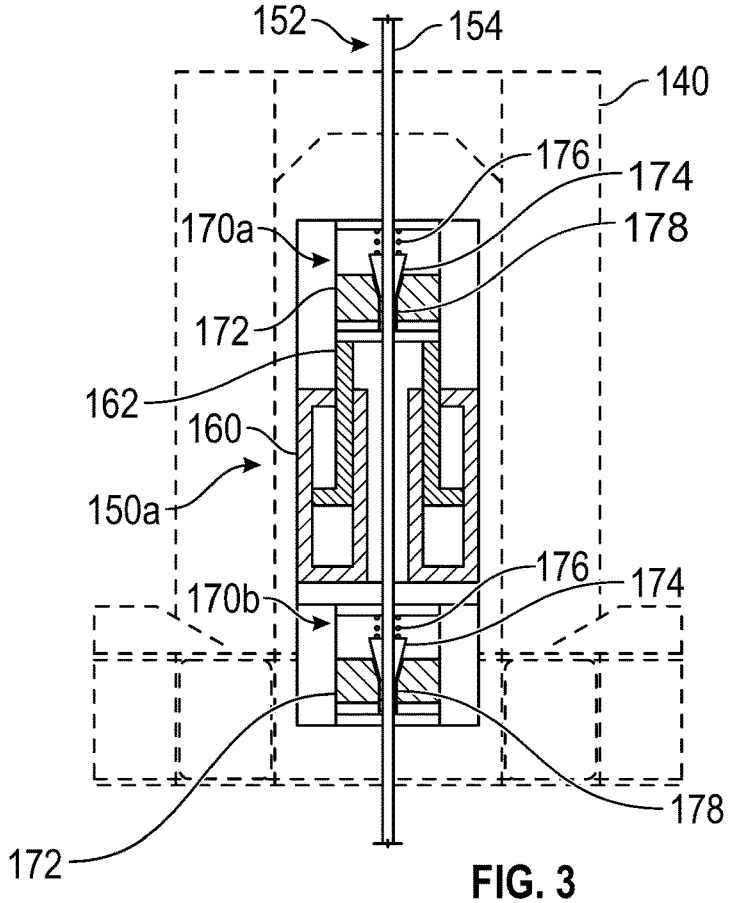
FIG. 3 illustrates a schematic view of a strand jack actuator of the elevator.
Figure 4B:
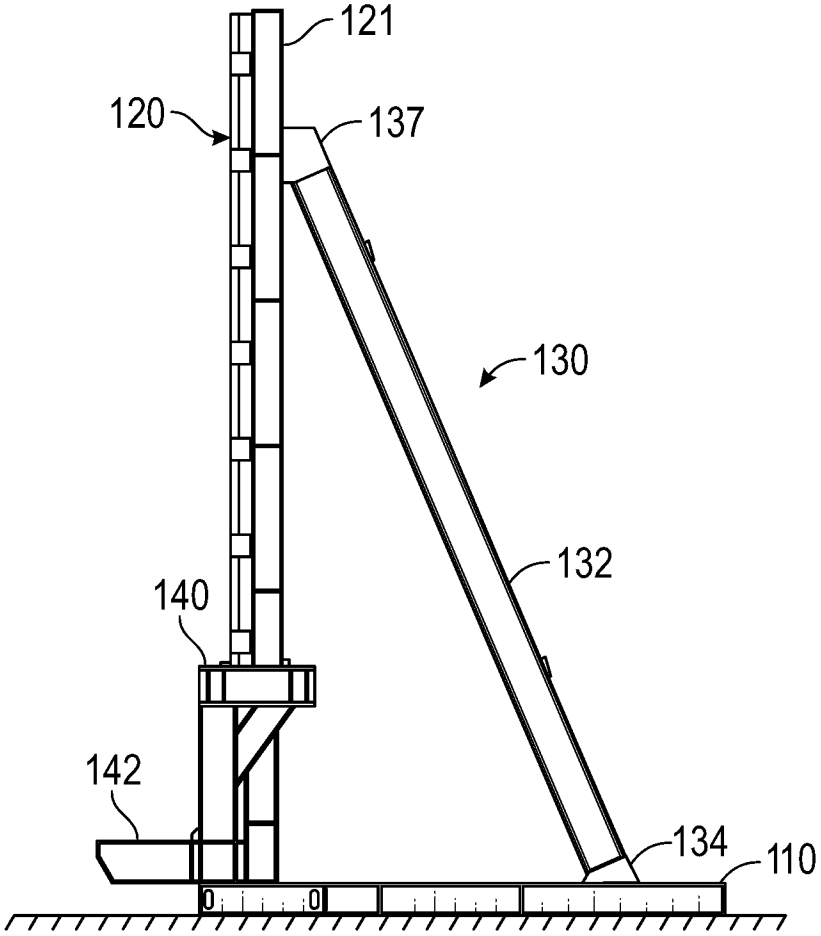
FIG. 4B illustrates a side elevational view of the disclosed lift.
Figure 4A:
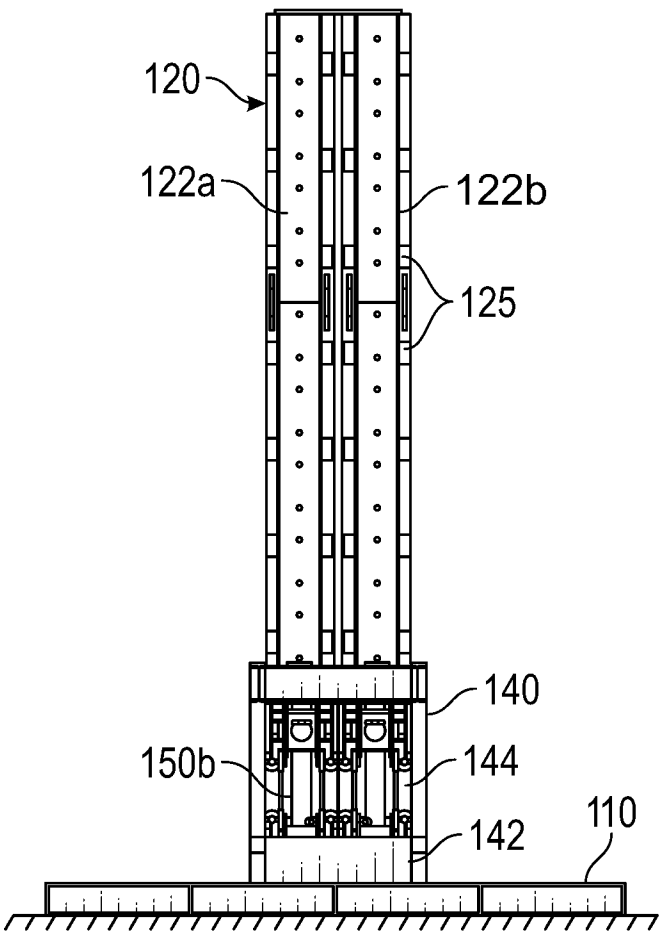
FIG. 4A illustrates a front elevational view of another lift according to the present disclosure.
Figure 4C:
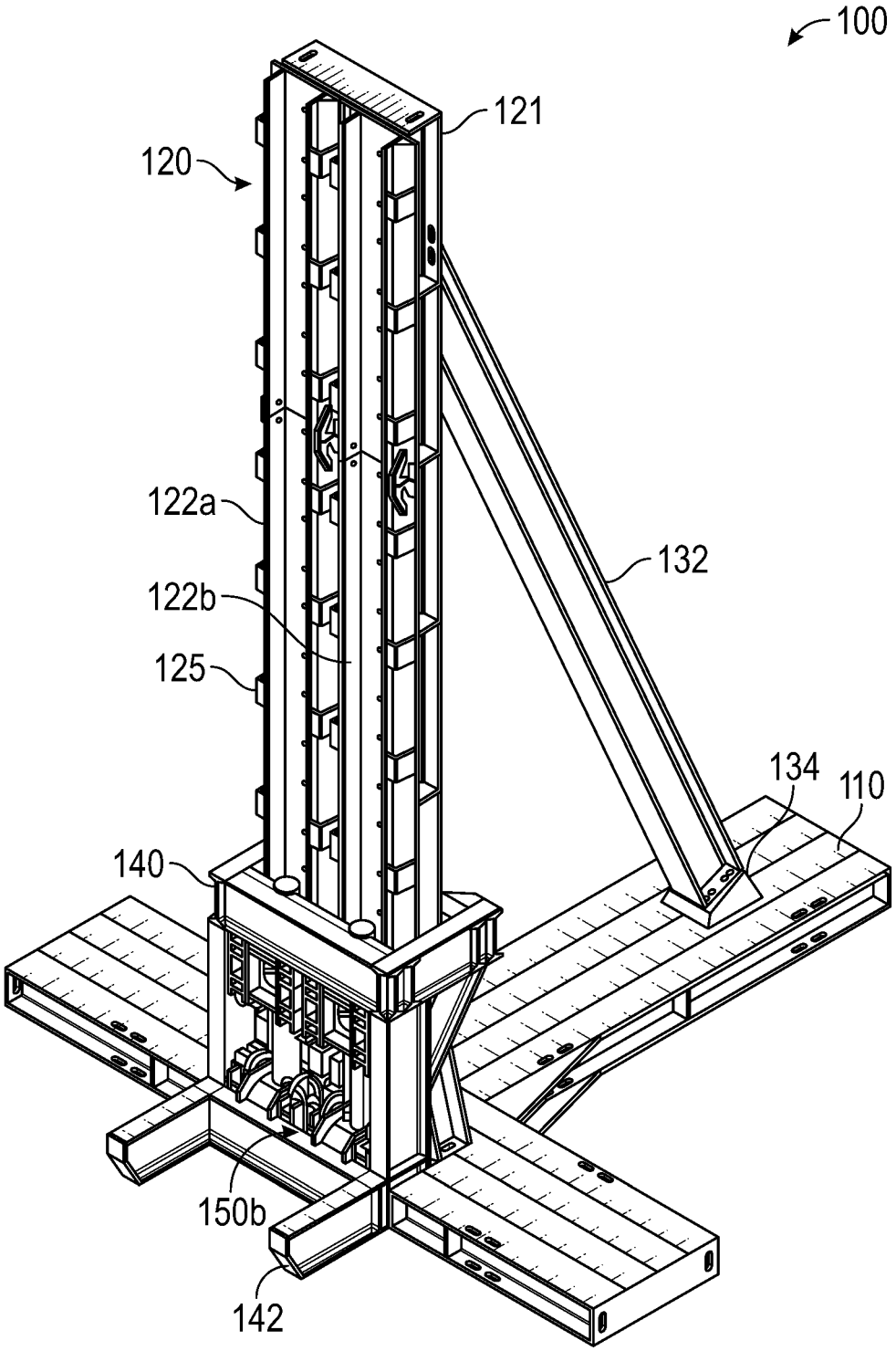
FIG. 4C illustrates a perspective view of the disclosed lift.
Figure 4D:
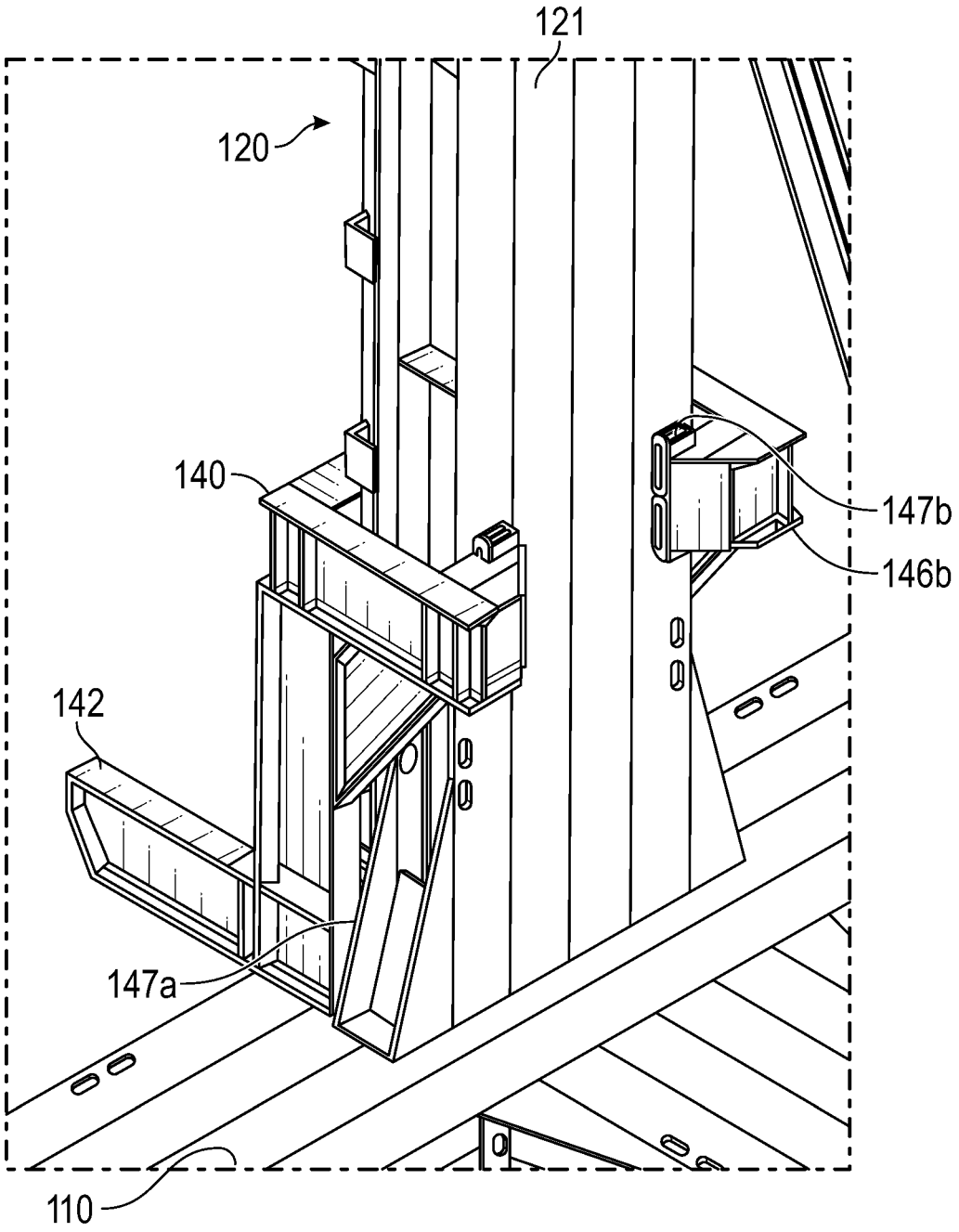
FIG. 4D illustrates another perspective view of a back portion of the disclosed lift.

As mentioned above and as shown schematically in FIG. 3, an actuator of the present disclosure includes a strand jack 150*a* for climbing and descending along a strand 152 of cables 154. For simplicity, only one cable 154 of the strand 152 is shown, but the strand 152 typically has a bundle of separate cables 154 extending parallel to one another. The strand jack 150*a* includes a hydraulic cylinder 160 and a piston 160. Supplied hydraulics from a hydraulic pressure unit (not shown) can extend and retract the piston 162 in the cylinder 160. This action is coordinated with the engagement and disengagement of upper and lower clamps 170*a-b* against the cable 154 of the strand 152. Each of the clamps 170*a-b* includes a support block 172 having a slip set 174 disposed about each of the cables 154, which pass through slots in the support block 172. Springs 176 bias against the slip sets 174 to wedge them in the slot of the support block 172, which prevents movement of the cable 152 in a downward direction. For each of the slip sets 174, the clamp 170*a-b* includes a push rod 178 through which the cable 154 passes. The push rod 178 can be lifted to unwedge the slip set 174 against the bias of the spring 176, which allows the block 172 to be moved relative to the cable 154.

To raise the elevator 140 and strand jack 150*a* along the strand 152, the lower clamp 170*b* is engaged with the strand 152, the upper clamp 170*a* is disengaged from the strand 152, and the cylinder 160 extends the piston 162. This increases the distance of the released upper clamp 170*a* from the engaged lower clamp 170*b*. The upper clamp 170*a* is then engaged with the strand 152, the lower clamp 170*b* is disengaged from the strand 152, and the piston 162 is retracted in the cylinder 160, which brings up the lower clamp 170*b* and elevator 140 along the strand 152 as the released lower clamp 170*b* is moved closer to the engaged upper clamp 170*a*. This process is repeated in stroked stages to raise the elevator 140 along the strand 152.

Lowering the elevator 140 along the strand 152 follows a comparable set of steps. The upper clamp 170*a* is engaged with the strand 152, the lower clamp 170*b* is disengaged from the strand 152, and the piston 162 is extended from the cylinder 160. This increases the distance of the released lower clamp 170*b* from the engaged upper clamp 170*a*. The lower clamp 170*b* is then engaged with the strand 152, the upper clamp 170*a* is disengaged from the strand 152, and the piston 162 is retracted in the cylinder 160, which brings down the released upper clamp 170*a* and elevator 140 along the strand 152 as the upper clamp 170*a* is moved closer to the engaged lower clamp 170*b*. This process is also repeated in stroked stages to lower the elevator 140 on the strand 152.

In addition to the strand jack 150*a* disposed on the elevator 140, other actuator arrangements can be used for the lift 100. As one example, a jack having a piston, cylinder, and clamps similar to that of a strand jack can be used to climb a monolithic central bar in much the same way as the strand jack climbs the strand of cables. In this configuration, the bar is used instead of a strand of cables.

As another example, FIGS. 4A-4D illustrate another lift 100 according to the present disclosure in various views. As before, the lift 100 includes a base 110, a tower 120, and an elevator 140. The base 110 provides a pad to support the lift 100 at a site and to transfer the load to the ground surface. In use as discussed below, the base 110 is placed to be adjacent one of at least two opposing sides of a load.

The tower 120 extends vertically from the base 110. To facilitate transport, the tower 120 can be a separate component from the base 110, and the tower 120 can have a foot that rests on the surface of the base 110. An integrated arrangement can also be used where the tower 120 is handedly connected to the base 110.

As shown, the tower 120 includes adjacent vertical rails or ladders 122*a-b* that can have a backwall 121. An arm 132 of a brace 130 connected at a knuckle 136 to the tower 120 extends to a back extent of the base 120. A foot or knuckle 134 at the end of the brace's arm 132 can affix to or engage the base 110. Although not shown, a counterweight can be placed at the back extent of the base 110 for the brace's knuckle 134 to abut against.

The rails 122*a-b* of the tower 120 include steps 125 disposed at successive heights, and the elevator 140 is disposed on the tower 120 to ride along the rails 122*a-b* by successively engaging the steps 125. The steps 125 in general include upward-facing shoulders for supporting the weight of a load. Various configurations are possible where the steps 125 include brackets, slots, openings, or the like to provide faces, edges, and sides for the upward-facing shoulders.

For its part, the elevator 140 has a support 142, an actuator 150*b*, and a second guide 144. The support 142 extends from the elevator 140 outward from the tower 120 and is configured to support a point at the edge of the load. For example, the elevator 140 can include a carriage or skid engaged with the tower 120, and the second guide 144 of the elevator 140 can use rollers and brackets similar to the previous embodiment so like reference numerals are used for comparable components. The support 142 can include forks extending perpendicularly from carriage 140.

The actuator 150*b* is configured to move the elevator 140 along the tower 120 to lift (raise/lower) the elevator 140 and any load supported by the support 142. In the current arrangement, the actuator 150*b* is a hydraulic actuator having a pair of push pull jacks that raise and lower the elevator 140 while maintaining support of the load. The push pull jacks 150*b* are extendable and retractable and have upper and lower locks. To climb the rails 122*a-b*, the push pull jacks 150*b* extend and retract while alternatingly engaging and disengaging the locks on the steps 125 of the rails 122*a-b*.

Figure 5C:
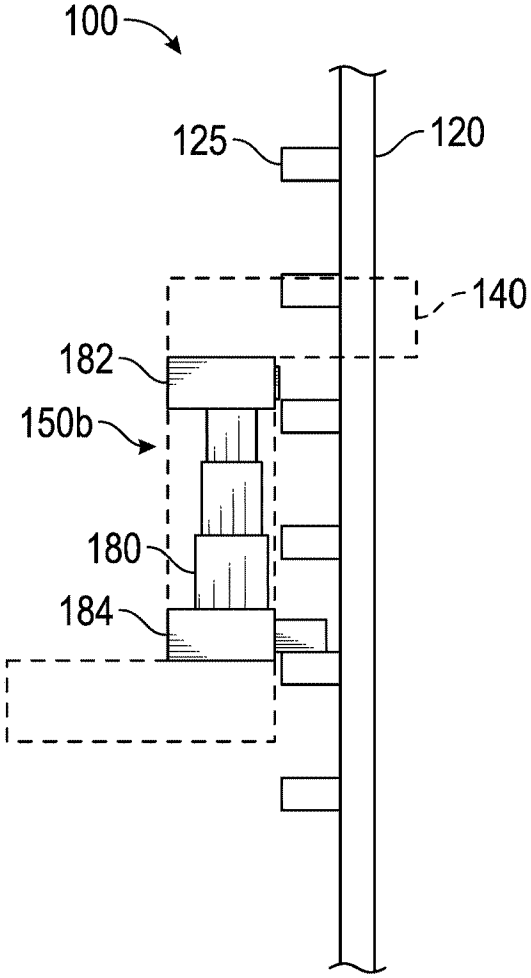
FIGS. 5A-5C illustrate schematic views of the actuator of the elevator.
Figure 5B:
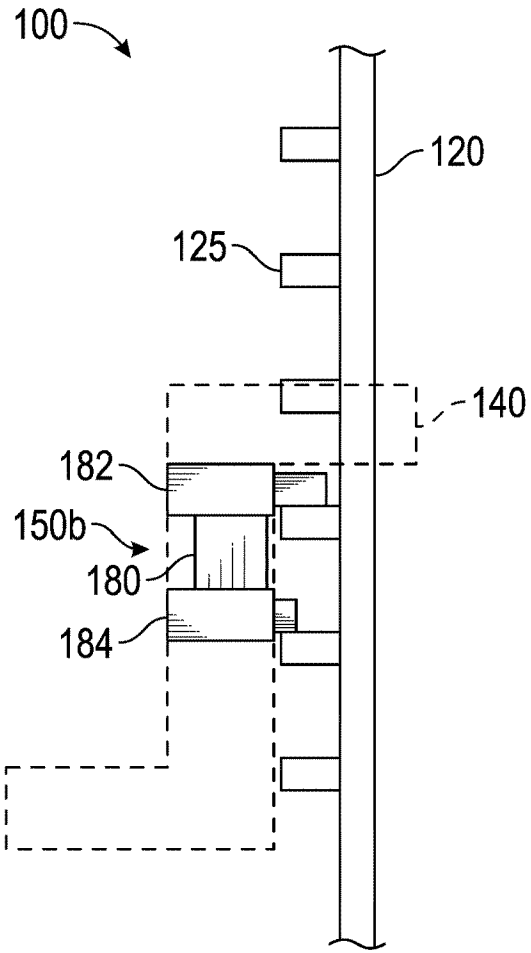
Figure 5A:
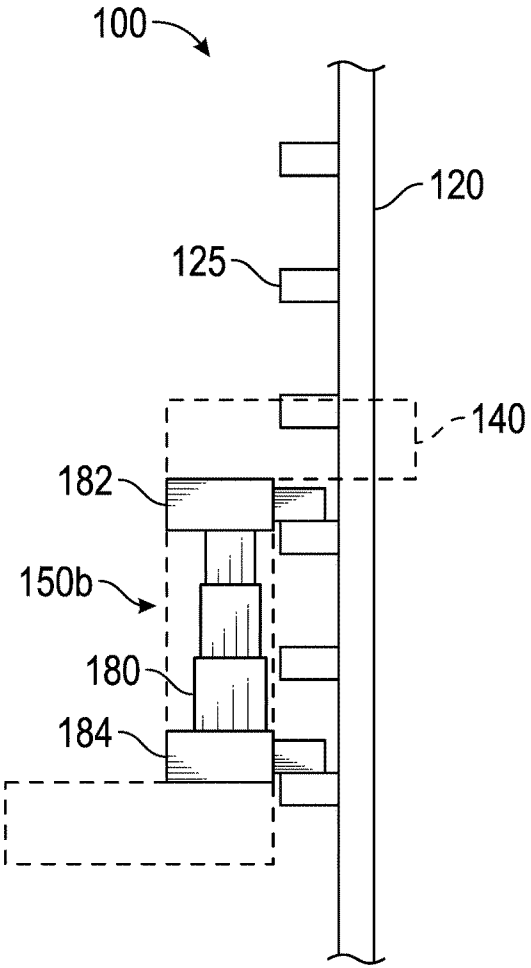

In particular, FIGS. 5A-5C illustrate a schematic view of the actuator 150*b* of the elevator 140. In FIG. 5A, the carriage of the elevator 140 is held on the tower 120 in a manner similar to that discussed previously. A push-pull jack 180 of the actuator 150*b* is shown in an extended state. Upper and lower locks 182, 184 of the actuator 150*b* engage the steps 125 so the lift 100 supports a load. To climb the tower 120, the lower lock 184 as shown in FIG. 5B is retracted from the step 125, and the push-pull jack 180 of the actuator 150*b* is retracted. This pulls the lower lock 184 vertically upward toward the engaged upper lock 182. Once the next step 125 is reached, the lower lock 184 is extended to engage the step 125. In a next stage, the upper lock 182 is retracted as shown in FIG. 5C, and the push-pull jack 180 is extended, which pushes the upper lock 182 toward the next step 125 on the tower 120. This process can be repeated in stroked stages to lift the elevator 140 and supported load along the tower 120. Climbing down the tower 120 can follow a reverse set of stroked stages.

In addition to the strand jack 150*a* and the push-pull jack 150*b* disposed on the elevator 140, other actuator arrangements can be used for the lift 100. For example, FIGS. 6A-6D illustrate schematic views of other actuator arrangements for the elevator 140 of the disclosed lift 100.

Figure 6A:
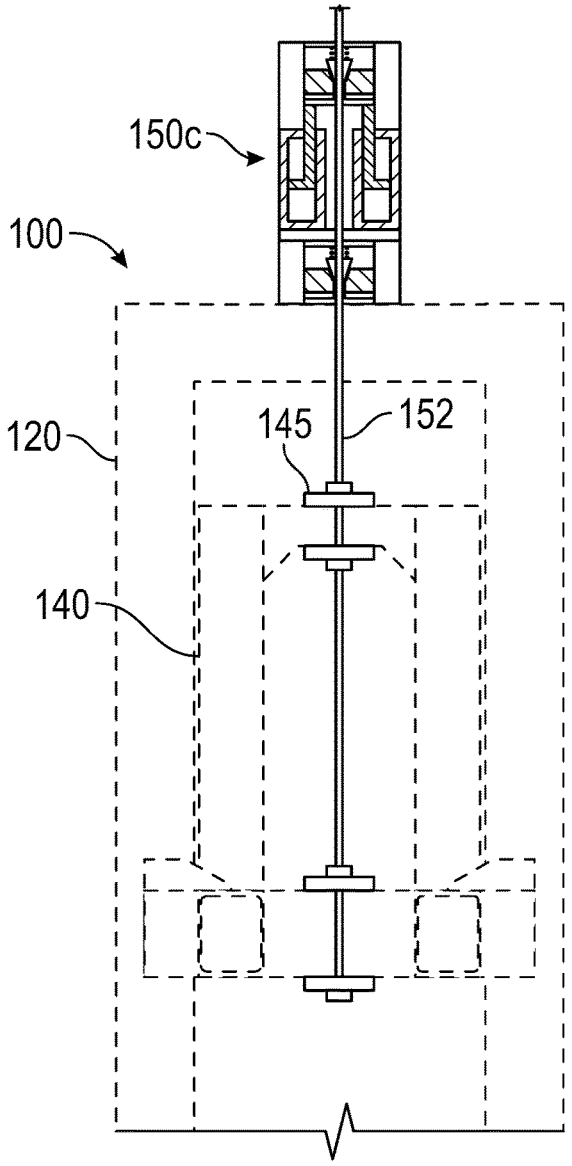
FIGS. 6A-6D illustrate schematic views of other actuator arrangements for the disclosed lifts.

In FIG. 6A, a strand jack 150*c* is mounted on the tower 120 of the lift 100, and the strand 152 passes through the strand jack 150*c*. The lower end of the strand 152 is affixed with one or more fixtures 145 to the elevator 140. As shown, the strand jack 150*b* can be mounted atop the tower 120. As this configuration may increase the height of the lift 100 and may make the tower 120 top heavy, the strand jack 150*b* can instead be mounted at the base of the tower 120, in which case a pulley arrangement may be used at the top of the tower 120 for the strand 152.

In this arrangement, the strand jack 150*b* raises and lowers the strand 152 and the elevator 140 supported on the strand 152. Any end of the strand 152 extending out of the strand jack 150*a* may be supported by a bent support (not shown), goose neck, or the like that can house the excess extent of the strand 152 during raising and lowering of the elevator 140.

Figure 6B:
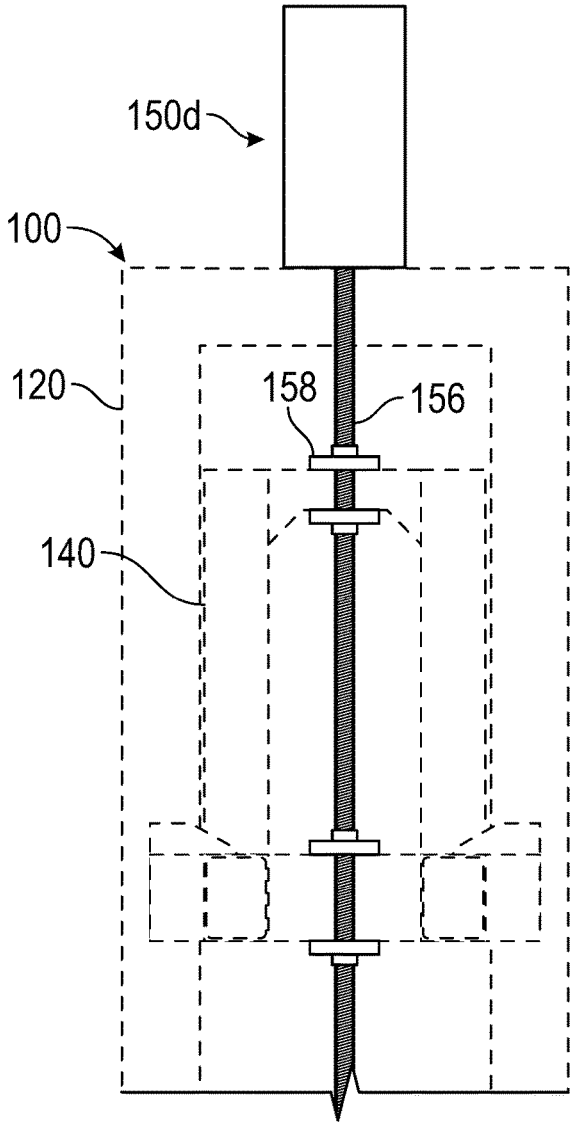

In FIG. 6B, the actuator includes a hydraulic or electric motor 150*d* mounted on the tower 120, either at the top as shown or at the bottom as space provides. The motor 150*d* can rotate a worm gear shaft or feed screw 156 in clockwise and counterclockwise directions to raise and lower the elevator 140, which is supported on the worm gear 156 by screw bearings or threaded couplings 158. As the worm gear shaft 156 is rotated, the screw bearings 158 ride along the gear of the shaft 156 to carry the elevator 140 along the shaft 156.

Figure 6C:
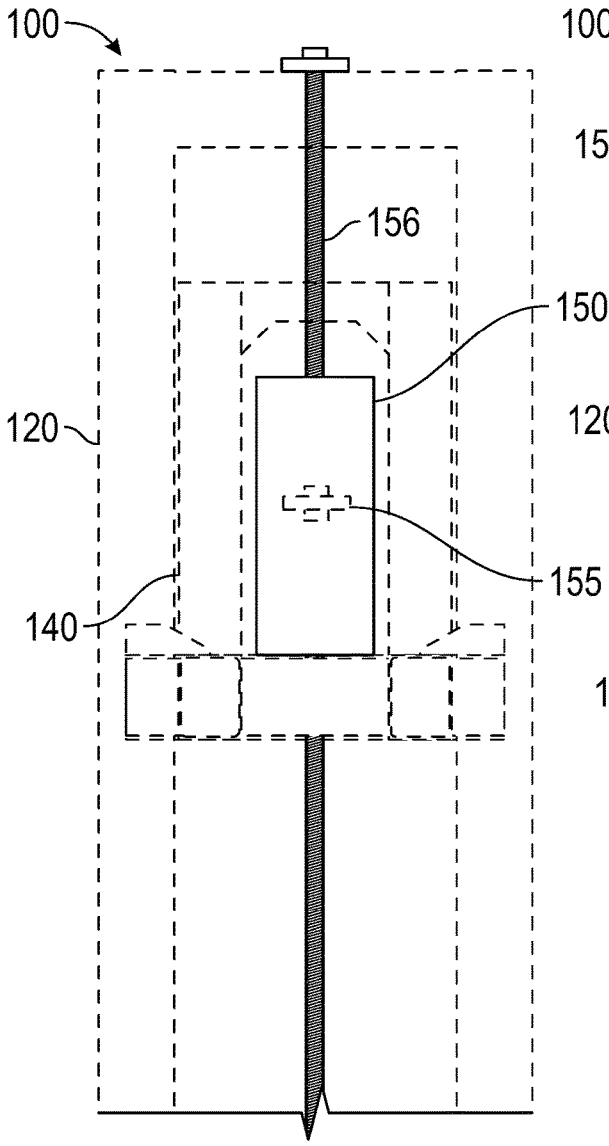

In FIG. 6C, a hydraulic or electric motor 150*e* can be mounted on the elevator 140. Here, the worm gear shaft 156 is not rotated. Instead, the motor 150*e* rotates screw bearings 155 inside the motor 150*b* to ride along the gear of the shaft 156.

Figure 6D:
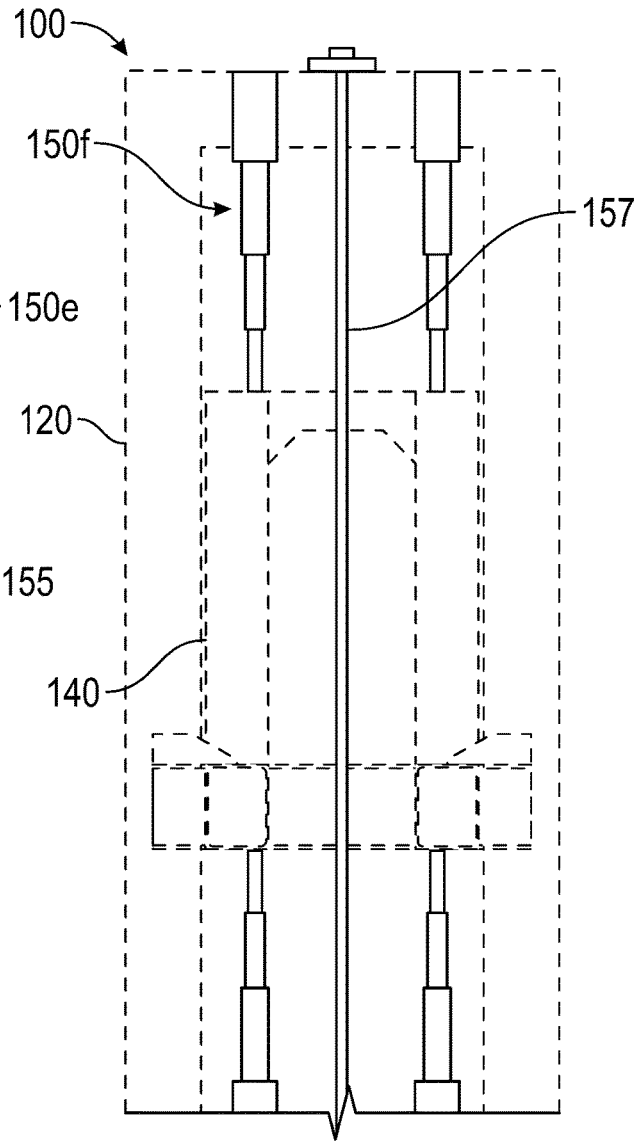

In FIG. 6D, one or more linear hydraulic pistons 150*f* on the tower 120 can raise and lower the elevator 140 along the rail of the tower 120. Here, a guide rod 157 may be provided. Also as shown here, upper and lower liner hydraulic pistons 150*f* can alternatingly extend and contract to move the elevator 140 along the tower 120.

Having an understanding of the lift 100 of the present disclosure, discussion now turns to how lifts 100 can be used together in a system to lift a load.

Figure 7A:
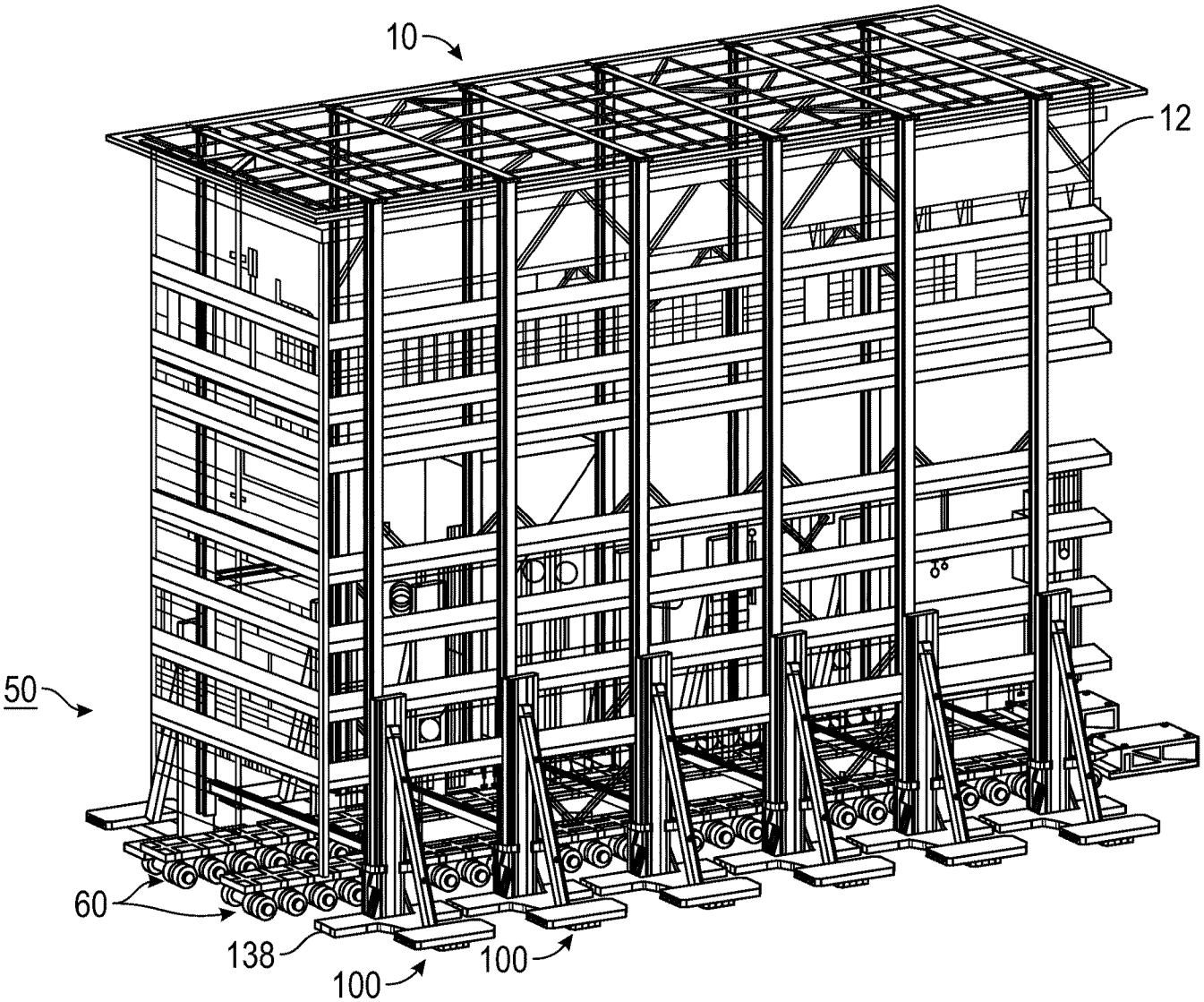
FIG. 7A illustrates a perspective view of a lift system of the present disclosure having a plurality of the disclosed lifts arranged at a site to lift a heavy oversized load.
Figure 7B:
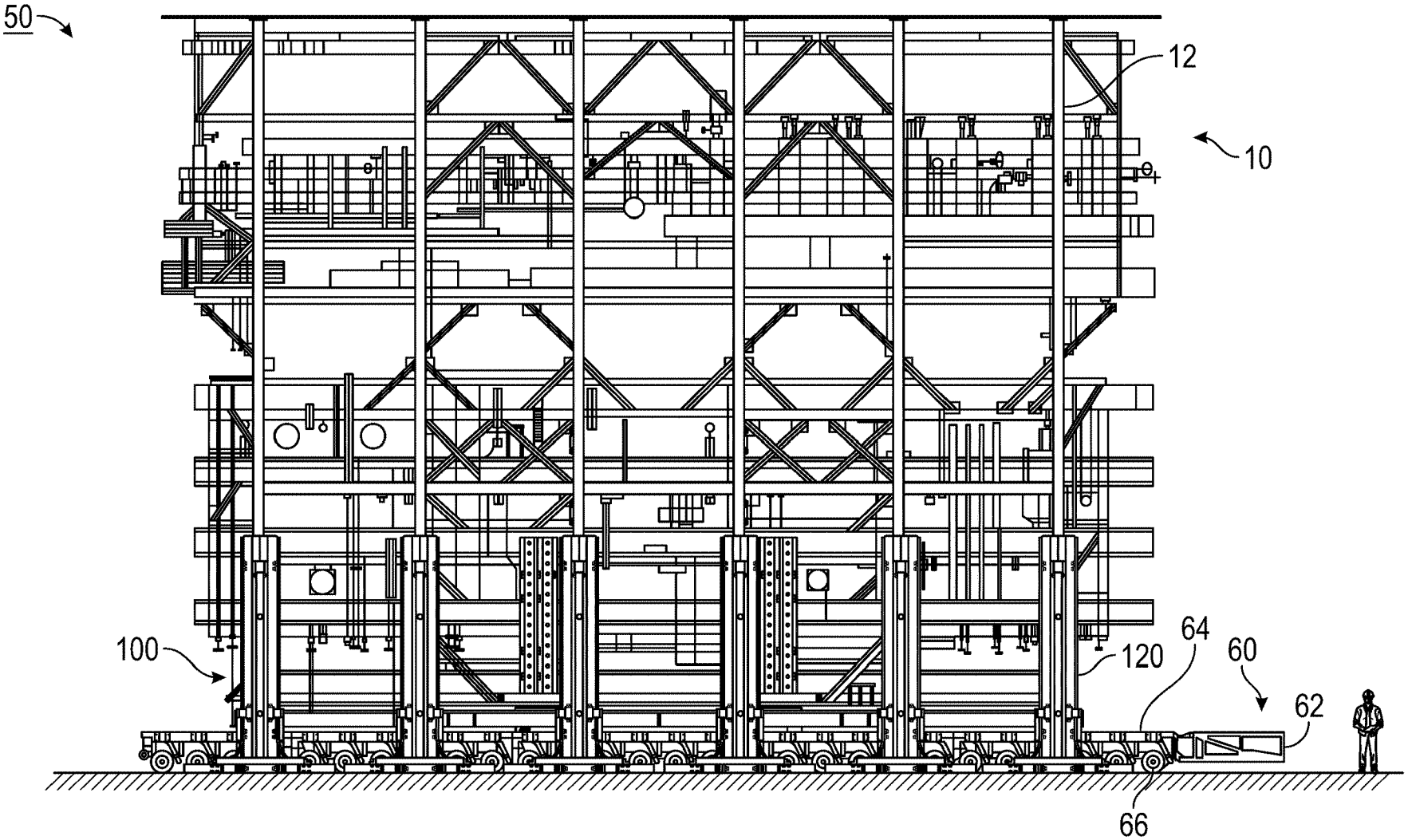
FIG. 7B illustrate a side elevational view of the lift system.
Figure 7C:
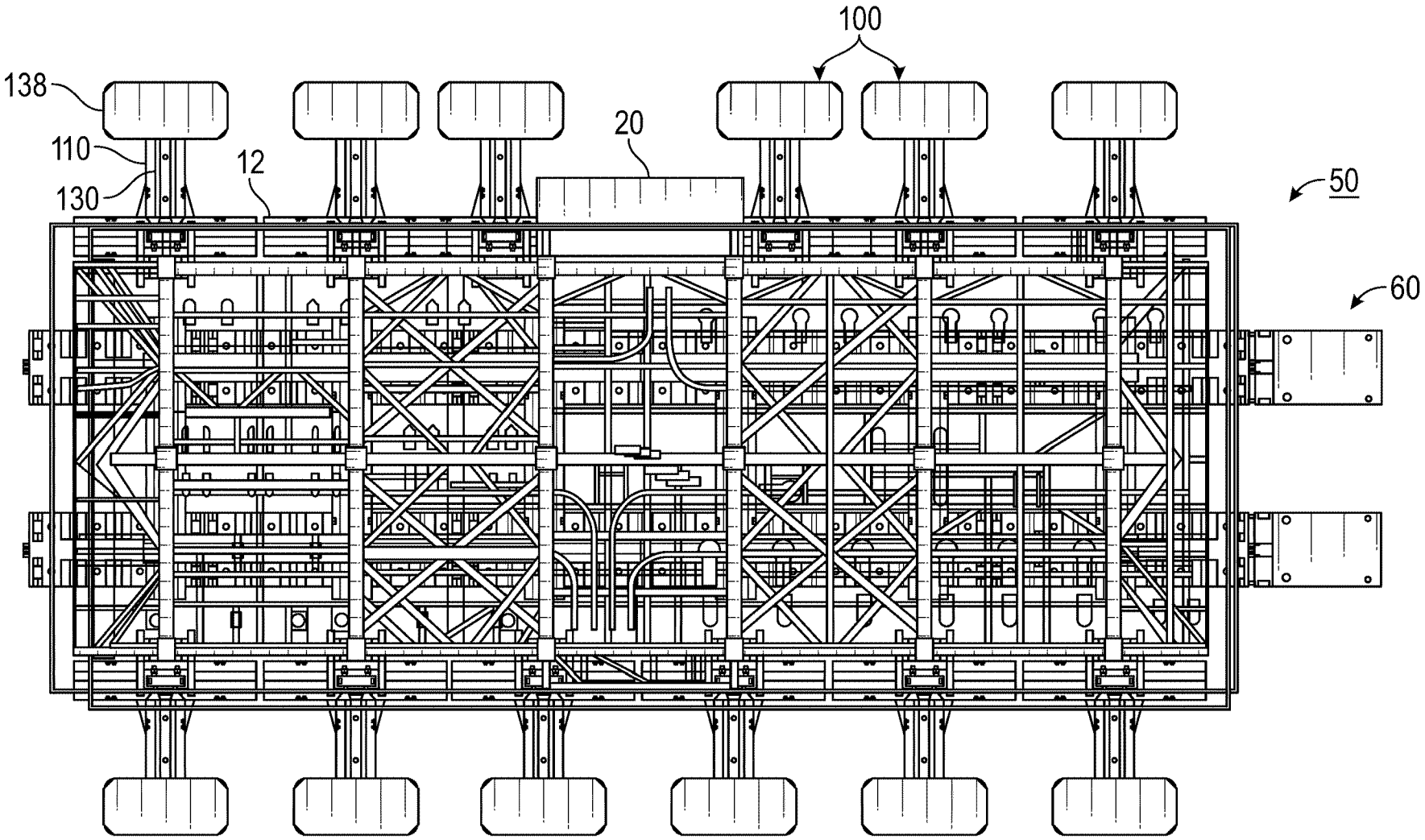
FIG. 7C illustrates a plan view of the lift system.

As shown in various views of FIGS. 7A-7C, a lift system 50 of the present disclosure uses a plurality of the disclosed lifts 100 arranged at a site to lift a heavy oversized load, which in this example is a structural element 10, such as a pipe rack module. The system 50 is modular and can be arranged and scaled to meet the required support of the structural element 10. Here, the structural element 10 is shown as a pipe rack module, but the system 50 can be used to lift any other suitable structure, module, and the like. In general, the structural element 10 can include a frame of beams 12, which are typically arranged vertically and horizontally. Other types of structural elements 10 and loads may have different components.

According to the present disclosure, the structural element 10 can be lifted to a desired height at a staging area using the lift system 50 having the plurality of lifts 100. As just an example, a pipe rack module can be about 50-ft. wide, 125-ft. long, and 90-ft. high. Depending on the implementation, each of the lifts 100 can have a tower height of about 30-ft, and each lift 100 may be able to lift such a pipe rack module about 22-ft. above the ground. Each lift 100 can be configured with a 100 ton capacity, a 150 ton capacity, or the like. For a given project, hundreds of structural elements may be delivered to the site for integration into a project's foundation. The lift system 50 of the present disclosure can be used to lift these structural elements 10 and other loads where space is restricted or congested.

Typically, the element 10 is transported to the site using mobile transports 60, such as one or more SPMTs. In heavy transport, such a high and wide structure element 10 like large pipe rack module can have a high center-of-gravity so the element 10 is typically transported on multiple rows of the mobile transports 60. Arranging several mobile transports 60 side-by-side creates a wider loading platform ensuring stability of the load during transport and enhancing safety. In general, the mobile transport 60 or SPMT includes a power pack unit ("PPU") 62 and a trailer unit having longitudinal columns 64, each having a plurality of single axle wheelsets 66.

Once at the site where the element 10 is to be lifted, the various lifts 100 are arranged along at least two opposing sides of the element 10 while the element 10 is supported on the transports 60. In this example, the element 10 has longitudinal sides, and the lifts 100 (twelve in all) are placed at support points for the structural beams 12 of the element 10 on both longitudinal sides. Other arrangements of the lifts 100 around the element 10 are possible depending on the size and shape of the element 10. The type, size, shape, and other factors of the element 10 will dictate the arrangement, number, etc. of the lifts 100 of the system 50, as will be appreciated.

Because the load is to be supported on opposing sides by the opposing lifts 100, which are set adjacent the sides of the structural element 10, the lifts 100 may not include a front of the base 110 or other form of front brace. Although they could have such a feature, the opposing support of the lifts 100 on the opposing sides of the element 10 may make such a front support feature unnecessary. Instead, a counterweight (138) can be placed on the back extent of the base 110 against which the foot of the brace 130 can engage.

Figure 8A:
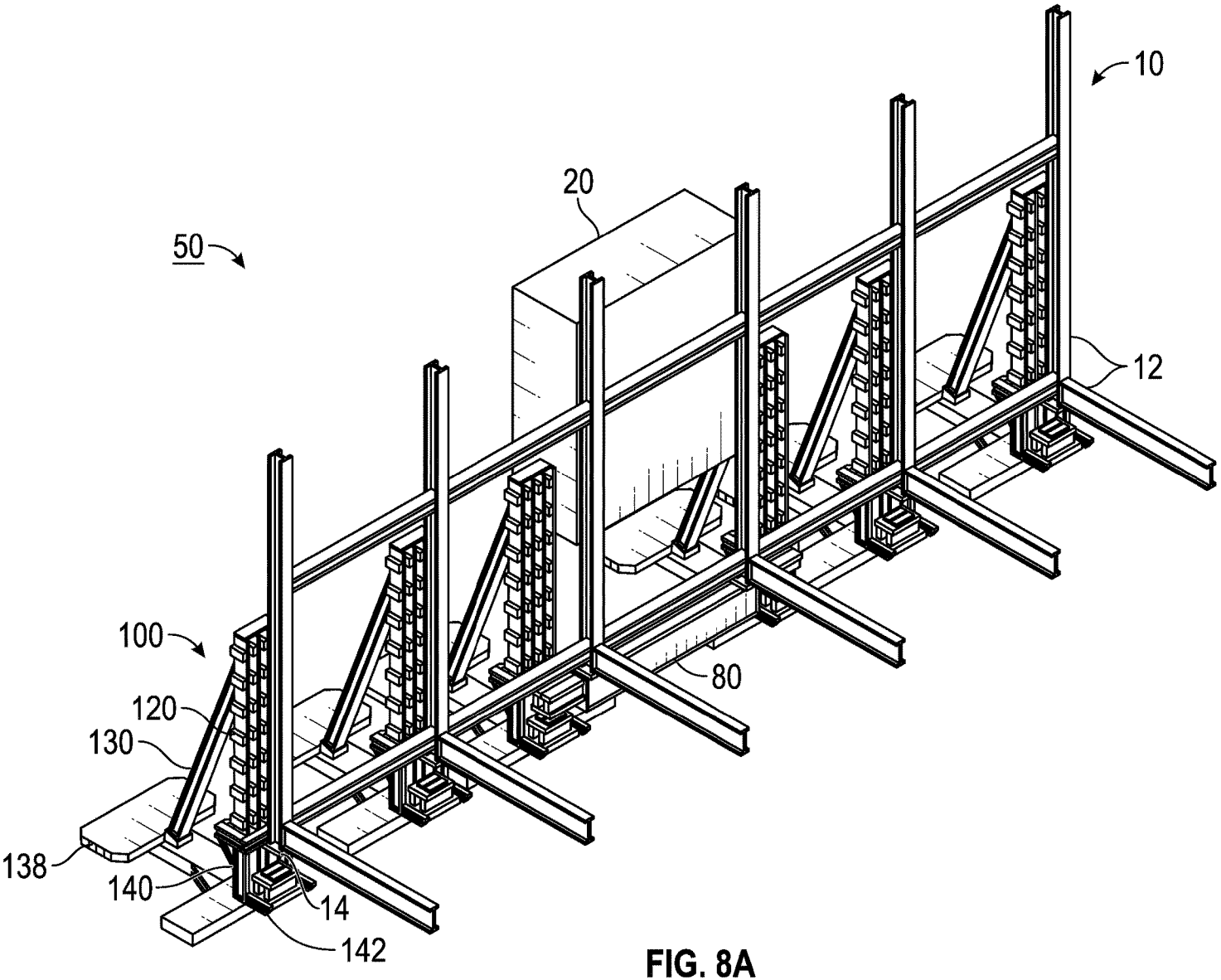
FIGS. 8A-8C illustrate perspective, side, and plan views of components of the lift system for supporting points along an edge of the load.
Figure 8B:
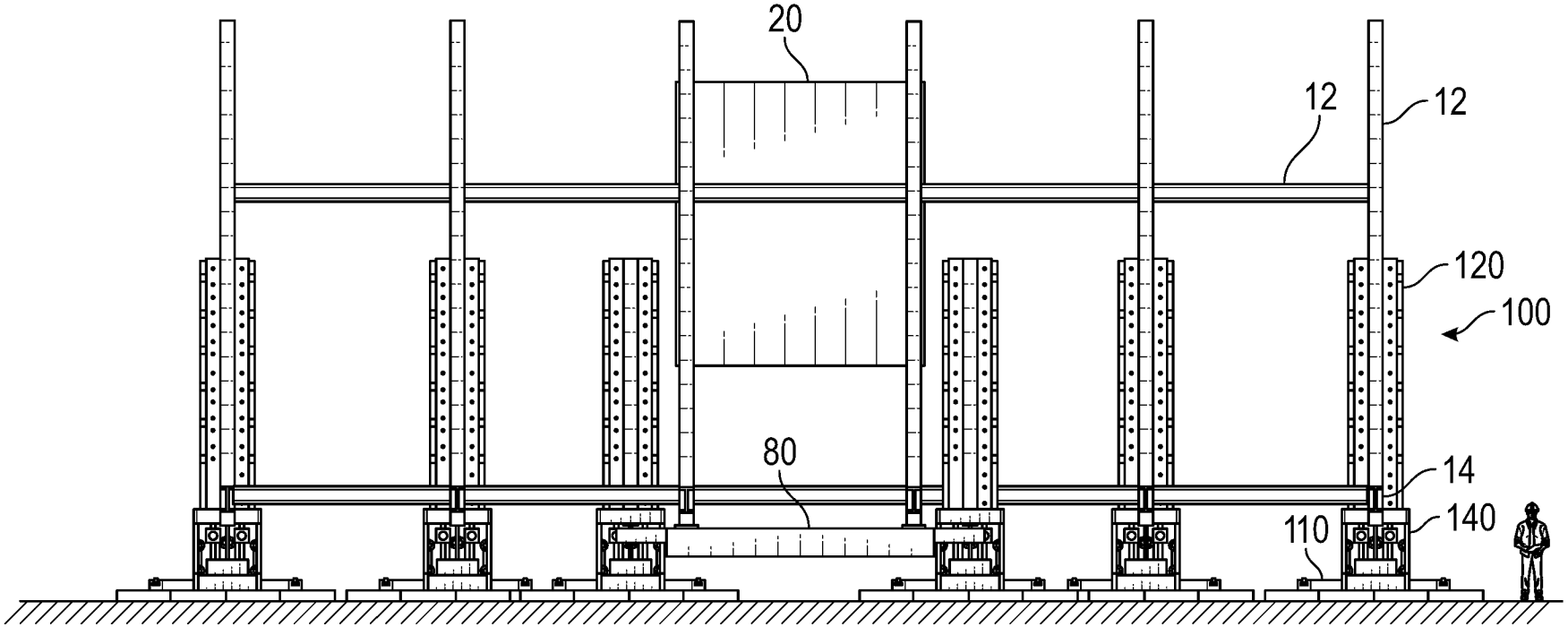
Figure 8C:
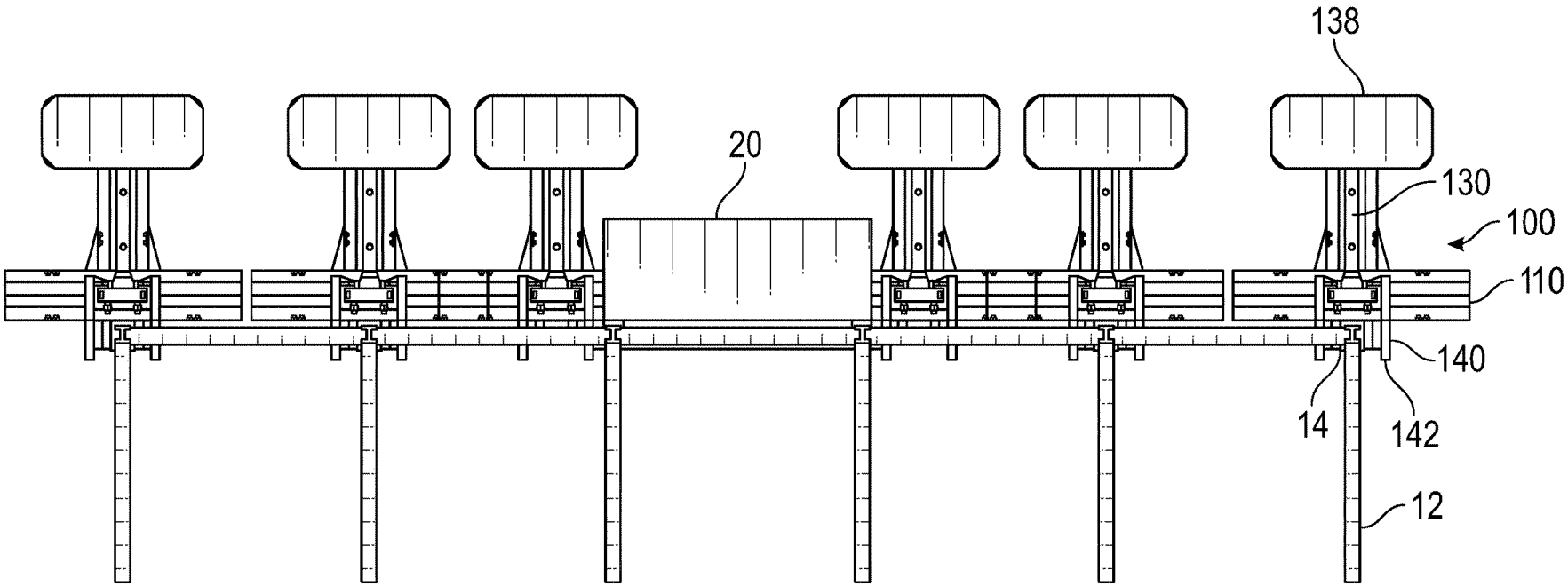
Figure 8D:
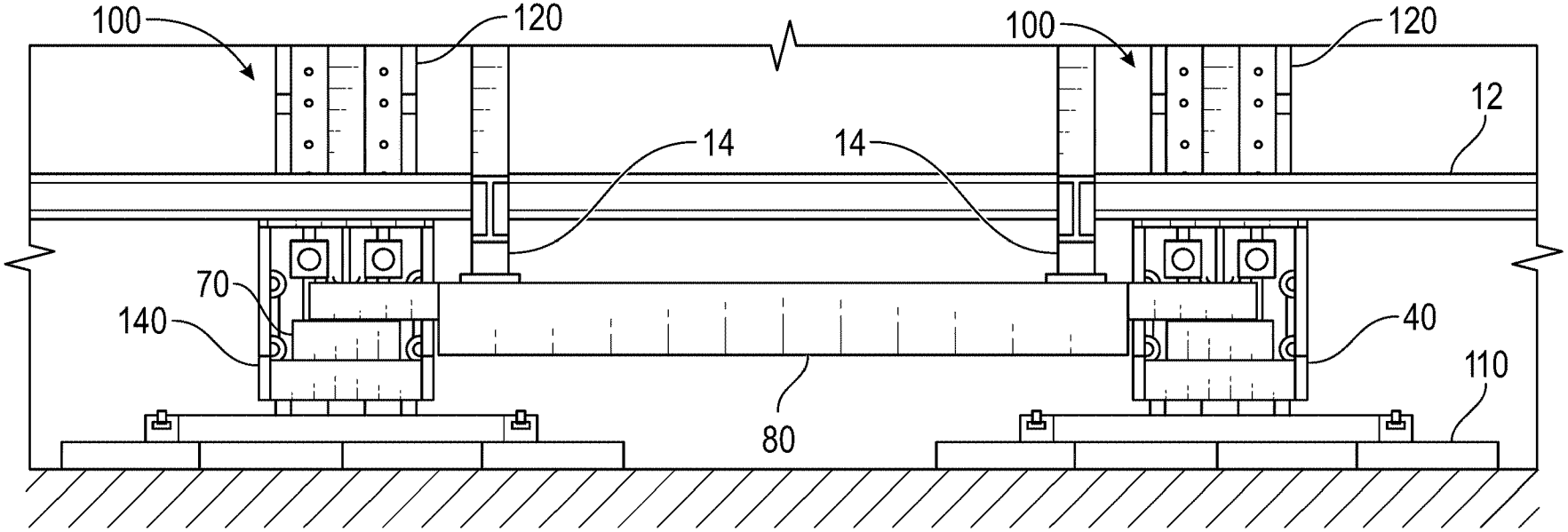
FIG. 8D illustrates a detail of the side view in FIG. 8B.

As can be seen in FIGS. 7A-7C, the towers 120 of the lifts 100 extend vertically adjacent the sides of the element 10. Should the element 10 include an outcropping or other obstruction (e.g., 20), then ancillary supports can be used to span between separated points along the side of the element 10. For example, FIGS. 8A-8C illustrate perspective, side, and plan views of components of the lift system 50 for supporting points (e.g., feet 14) along an edge of the structural element 10. FIG. 8D illustrates a detail of the side view in FIG. 8B.

As shown in FIGS. 8A-8D, an ancillary support beam 80 spans between support points of the structural element 10. A first end of the beam 80 is engaged by a first of the lifts 100, and a second end of the beam 80 is engaged by a second of the lifts 100. An intermediate portion of the beam 80 supports one or more intermediate points, which may include a foot 14 on the beams 12 of the element 10. In this way, the load can be distributed between the adjacent lifts 100. As an alternative, the ancillary support beam 80 can be used on one lift 100 to engage adjacent support points (e.g., feet 14) on the structural element 10.

Preferably, the supports 142 of the lifts 100 are used at structural points on the element 10. Here for example, the pipe rack module has cross beams and vertical beams 12 that meet at feet 14. The supports 142 on the lifts 10 can use falsework or pads 70 under the feet 14 to support the structural element 10. Other arrangements are possible depending on the type of structural element 10 and its construction.

Figure 9A:
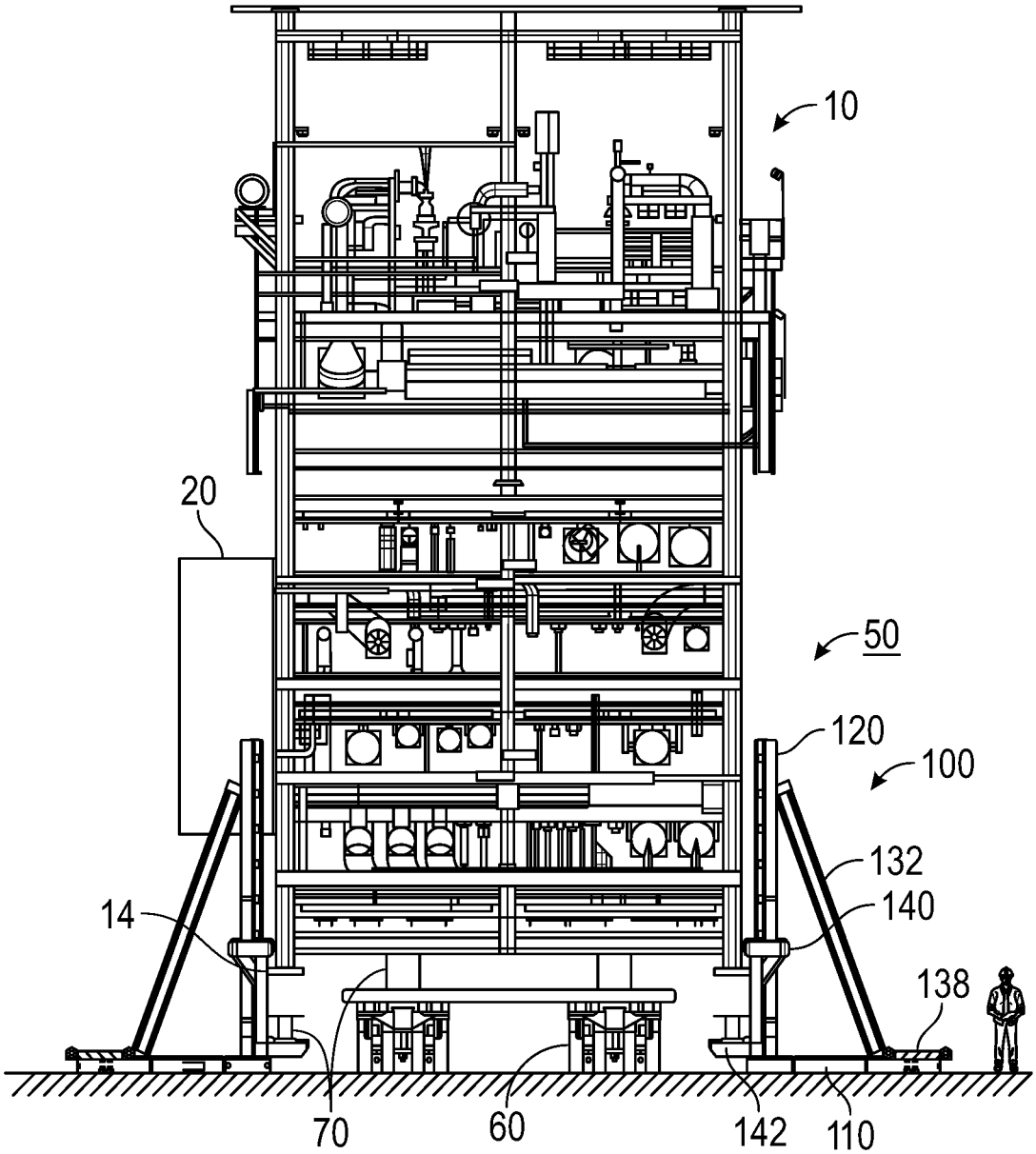
FIGS. 9A-9B illustrate end views of the disclosed lift system lifting the load from mobile transports.
Figure 9B:
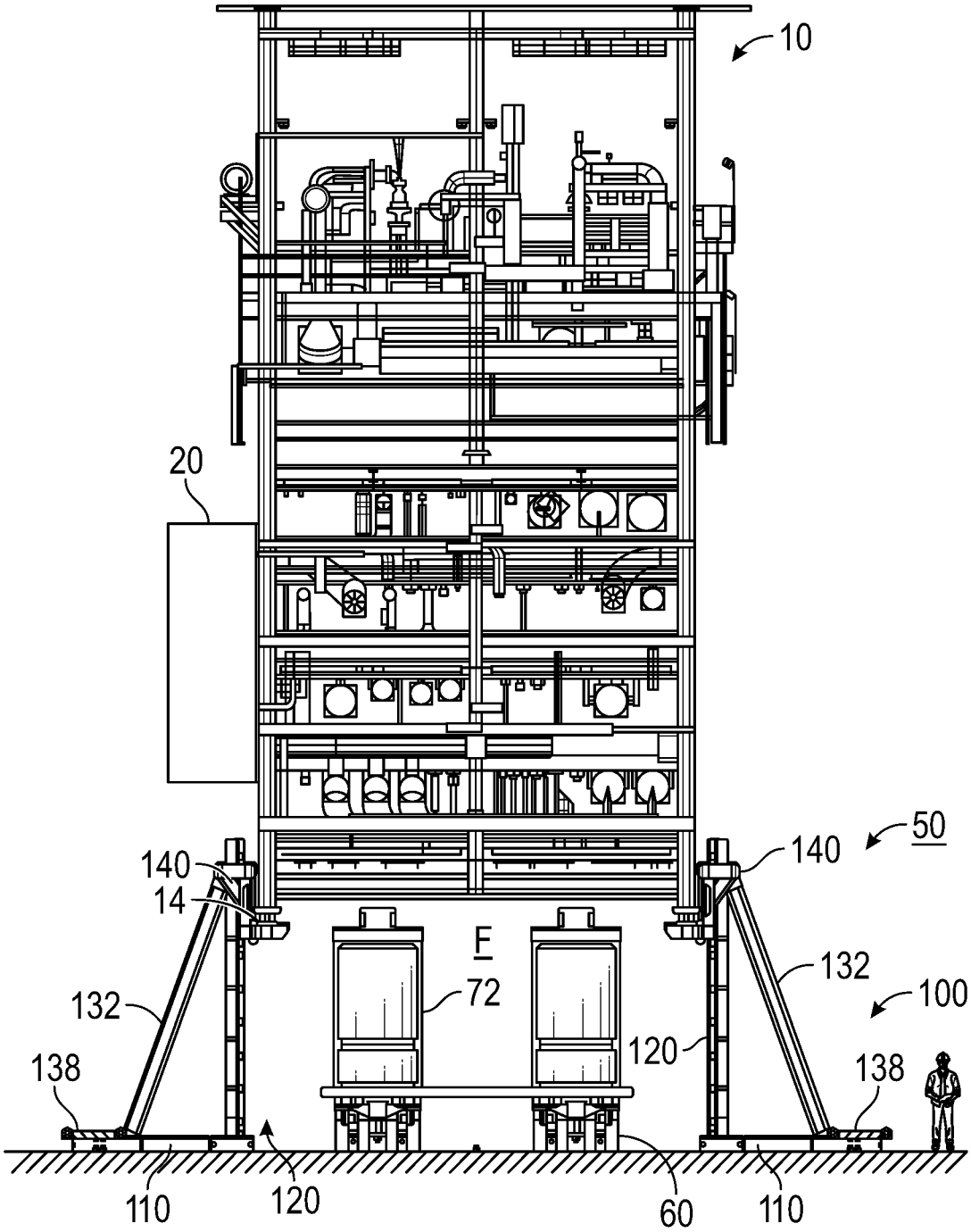

FIGS. 9A-9B illustrate end views of the disclosed lift system 50 lifting the structural element 10 from mobile transports 60. FIG. 9B illustrates the element 10 lifted above mobile transports 60 having additional components installed under the structural element 10.

In use, a plurality of the lifts 100 are arranged along at least two opposing sides of the structural element 10 to be lifted. The structural element 10 is supported at points along the at least two opposing sides by engaging the supports 142 of the lifts 100 at the points and leaving the space (F) under the structural element 10 free. The oversized structural element 10 is then lifted (raised/lowered) relative to the free space (F) under the structural element 10 by operating each of the lifts 100. Any desired operation can be performed in the free space (F) under the structural element 10 without obstruction from the lifts 100.

For example, the lifts 100 can raise the structural element 10, and the transports 60 that transported the element 10 to the staging area can be removed from under the structural element 10. Additional structures can then be added under the raise element 10. As shown in FIGS. 9A-9B, the original falsework on the transports 60 can be replaced by containers 72 on the transport modules 60, which can then be moved back in the free space (F) under the lifted element 10. At this point, the lifts 100 can be operated to lower the structural element 10 onto the containers 72.

Figure 10:
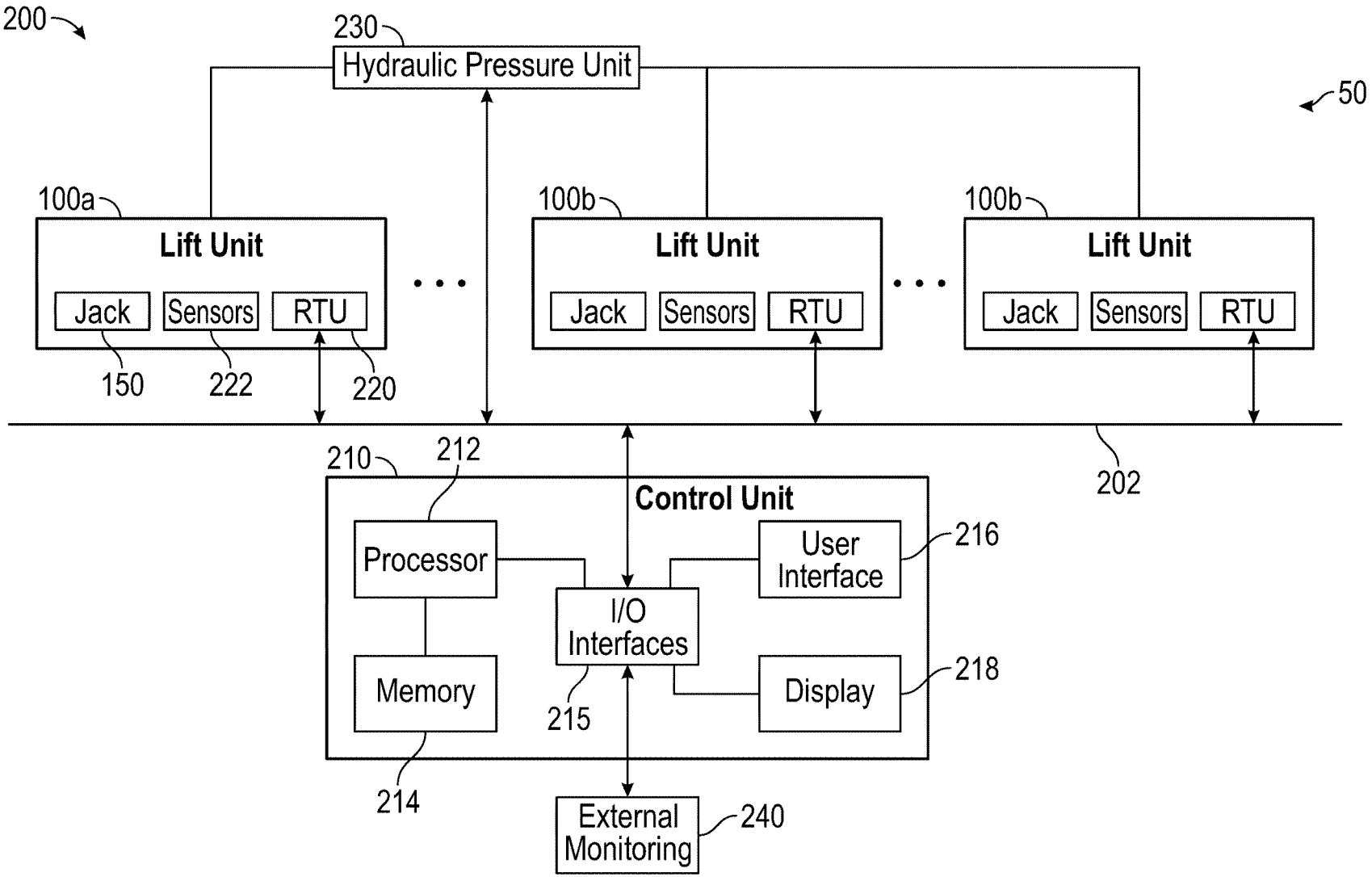
FIG. 10 illustrates a schematic view of a control system for the disclosed lift system.

FIG. 10 illustrates a schematic view of a control system 200 for the disclosed lift system (50). The control system 200 is disposed in operational communication with each of the lifts 100*a*, 100*b* . . . 100*n* for monitoring and controlling the hydraulics, power, etc. of the actuators 150 and the height of the elevators (140) in lifting a load, such as the previously-shown pipe rack module (10). To maintain the load (10) level and supported, the control system 200 can operate the lifts 100*a-n* concurrently to lift (raise/lower) the element (10) (i.e., the system 200 can operate the lifts 100*a-n* to stroke together in unison), and the control system 200 can individually control each lift 100*a-n* (i.e., the system 200 can operate a given lift 100*a-n* to stroke on its own). Stability of the load (10) is important due to the considerably high center of gravity of the load so the independent control of each lift 100*a-n* by the control system 200 can be used to fine tune the support, level, and balance of the load during the lifting (raising/lowering).

The control system 200 can take a number of configurations. As shown in the present example, the control system 200 includes a control unit 210 having a processing unit 212, memory 214, input-output interfaces 215, a user interface 216, and a display 218, among other necessary components. The control unit 210 can be a general purpose computer or a dedicated computing device. The processing unit 212 and memory 214 can use any acceptable equipment suited for use in the field at a site. For example, the processing unit 212 can include a suitable processor, digital electronic circuitry, computer hardware, computer firmware, computer software, and any combination thereof. The memory 214 can include any suitable storage device for computer program instructions and data, such as EPROM, EEPROM, flash memory device, magnetic disks, magneto-optical disks, ASICs (application-specific integrated circuits), etc.

The user interface 216 and display 218 allow operators to monitor and control the lift operation of the lift system (50) and monitor and control the stability of the load (10).

The input-output interfaces 215 connects with one or more communication links 202, which can use wired communications, although wireless communication can be used. Each of the lift units 100*a-n* connects to the central control unit 210 and includes components of the lift 100*a-n* of the present disclosure, such as the actuator 150 (e.g., strand jack) and its features. The lift unit 100*a-n* includes sensors 222 to monitor stroke and load of the actuator 150. Sensors 220 can be used to monitor hydraulic pressure, power, etc. and to monitor the height of the elevator (140). Other sensors 222 can be used, such as stain gauges, load cells, and like to monitor parameters needed for control and monitoring of the lift's operation. The lift unit 100*a-n* can further include its own controller 220, such as a remote terminal unit (RTU) or other electronic device having a microprocessor that can interface with components of the lift unit 100*a-n* and the central control unit 210.

The lift units 100*a-n* connect to a power source 230, shown here as a hydraulic pressure unit 230 that provides the hydraulic pressure for the various lift units 100*a-n*. One or more such hydraulic pressure units 230 may be used, and redundancy systems may be provided. Each lift unit 100*a-n* could have its own hydraulic pressure unit 230. Either way, the hydraulic pressure unit 230 is connected to the control unit 210, which can monitor and control the unit 100*a-n* and the hydraulic pressure supplied.

As shown, the control unit 210 can further connect to external monitoring equipment 240, such as used to monitor the load (10) with respect to its level, center of gravity, load distribution, etc. This external monitoring equipment 240 can include optical device, level gauges, strain gauges, load cells, inclinometers, and the like for monitoring the load (10) during lifting for level, balance, stability, etc. Additionally, the external monitoring equipment 240 can use surveying components to monitor each of the lifts 100*a-n* for settlement in the ground. During operation, for example, the actuator 150 of a lift 100 may show proper stroke and load readings, but the lift 100*a-n* itself may have begun to settle or sink into the ground during the lifting. The external surveying equipment, which can uses laser sights and the like, can detect the settling of the lifts 100*a-n* during operation.

Figure 11:
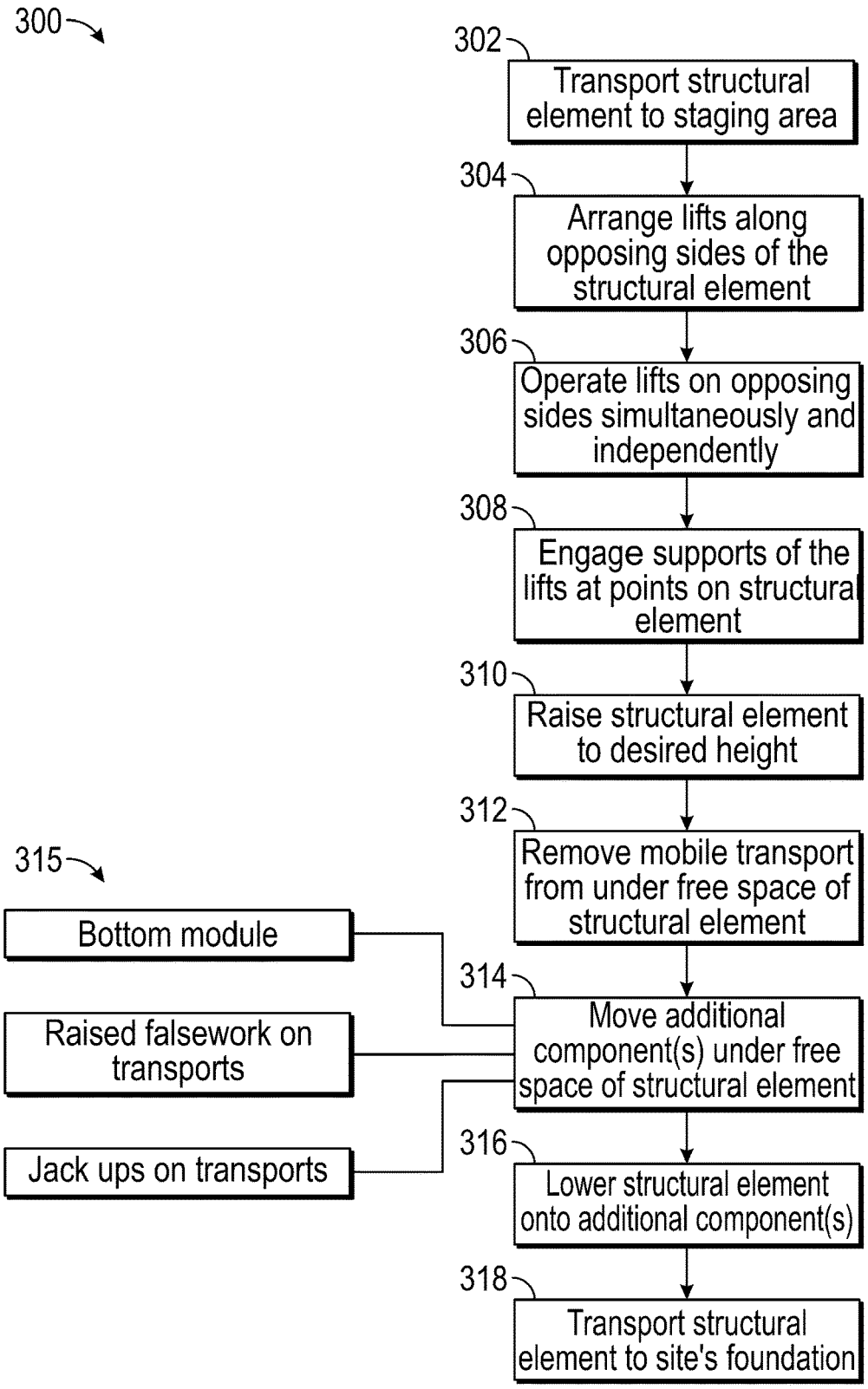
FIG. 11 illustrates a process of lifting a heavy, oversized load with the disclosed lift system.

As will be appreciated with the benefit of the present disclosure, the lifts 100 and lift system 50 disclosed herein can be used in a number of applications for lifting loads. As an example, FIG. 11 illustrates one such process 300 of lifting a heavy, oversized load, such as the previously-shown pipe rack module 10, with the disclosed lift system 50. Reference to elements in the other figures are provided in this discussion for better understanding of the process 300. As noted herein, the lift system 50 can be used to lift (raise/lower) for a number of purposes when transporting and/or installing loads (e.g., modules) 10 at a site.

In general, the module 10 can be transported to a staging area or can be constructed on site. In this example, the module 10 is transported to a staging area at a site (Block 302). For example, a ship or barge may transport the module 10 to a dock, and mobile transports 60 can transport the element 10 to the staging area.

The lifts 100 of the disclosed lift system 50 are arranged along opposing sides of the module 10 according to the size, weight, and shape of the module 10 (Block 304). The lifts 100 are then operated simultaneously and independently (Block 306), and the support 142 of the lifts 100 are engaged at points along the sides and/or edges of the module 10 (Block 308). With the lift system 50 ready to take the load of the module 10, the lift system 50 brings the module 10 off of the mobile transports 60 and raises the element 10 to a desired height (Block 310).

At this point, additional operations can be performed in the free space (F) underneath the module 10. As discussed herein, the lifts 100 along the opposing sides of the lifted module 10 do not impeded movement of mobile transports 60 and the like underneath the lifted module 10. In this way, mobile transports 60, temporary stands, other modules 10, or the like can be moved in and out from the free space (F) under the element 10 lifted on the lifts 100.

Accordingly, in one example, the mobile transports 60 can be moved from underneath the lifted element 10 and can be outfitted with a number of bases installed on mobile transports (Block 312). The bases on the mobile transports 60 can be brought back underneath the element 10 (Block 314), and the lifts 100 can then lower the module 10 onto the bases supported on the mobile transports 60 (Block 316). Once load is transferred, the module 10 in its raised condition can be transported to a destination to be integrated into other structural elements and modules at the site (Block 318). The raised condition may facilitate integration of the element into other components and the site. For example, the pipe module may be brought over support columns on at the site, and the feet of the module can be connected on the support columns.

In another example while the module 10 is raised by the lift system 50 at Block 314, a sub-module can be brought underneath the raised element 10 using mobile transports 60. The raised module 10 can then be lowered and mated with the lower sub-module to complete a unit for integration at the site.

At some sites, initial loading of the module 10 in a raised condition of the mobile transports 60 at the dock or the like using a crane may not be possible due to the required transport of the module 10 to a worksite. An overhead obstruction may be present along the way, requiring the module 10 to be transported directly on the mobile transports 60 without any raising by bases. Instead, low-profile falsework on the transports 60 can be used. Also, transportation of the module 10 in a raised condition may be less stable or less practical under the circumstances. To that end, the disclosed lift system 50 enables the lifting of the module 10 off the mobile transports 60 at a staging area so further preparations can be made to integrate the element 10 into the overall structure at the site.

In other situations, a pipe rack module or other module 10 may be built at the site while supported on load spreaders on the ground. The lift system 100 is then used to lift the constructed module 10 to a height. Mobile transports 60 with raised falsework (e.g., support base(s)) are driven under the lifted module 10, which is then lowered to the supporting falsework on the mobile transports 60. The module 10 can then be transported to the foundation for installation.

In another example, a bottom module and a top module may be built at the site while supported on load spreaders on the ground, or they may be transported separately to the site. The lift system 50 is then used to lift the bottom module 10 to a height. Mobile transports 60 are driven under the lifted module 10, which is then lowered to supporting falsework on the mobile transports 60. The module 10 can then be moved from the lift system 50. The lift system 80 can then be arranged around the top module and used to lift the top module 10 to required height. At this point, the lower module 10 can be moved by transports 60 under the lifted free space (F) under the top module 10, and the two modules 10 can be connected together and transported.

As noted, the disclosed system 50 can be used to raise a load, such as a pipe rack module 10 so it can be integrated into a foundation at a worksite or can be mounted atop other components. Additionally, the disclosed system 50 can be used to lower a load, structural element, pipe rack module 10, etc. so it can be lowered to an elevation below the ground at a worksite. The disclosed system 50 can be used to undeck equipment and components, such as for undecking shovels used in the mining industry, undecking pressure vessels, etc.

The disclosed system 50 and lifts 100 have a number of advantages. After setup, the lift system 50 only requires one centralized operator, which may not be possible with conventional lifting techniques that use multiple cranes or the like.

In contrast to existing jack ups, the disclosed lift system 50 has a low starting height. For this reason, there is no need to raise the structural element 10 to an initial height before using the disclosed lift system 50 to lift the element 10 to further heights. Conventional jack-up systems can require the element to be first raised to an initial height to allow the jacks to be placed under the element for lifting.

Operation of the lifts 100 and the lift system 50 requires less time than conventional jack-up systems, which require successive jack up components to be transported and used. The disclosed lifts 100 can collapse for transport, and the system 50 can be shipped in containers where needed. This allows the system's components to be moved and set up with equipment on hand with less time required to assemble and disassemble.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A system for lifting a heavy oversized load, the load having at least two opposing sides, the system comprising:

at least two opposing lifts for placement adjacent the at least two opposing sides of the load, each of the lifts comprising:

a base;

a tower extending vertically from the base, the tower having a front and a back and having first opposing edges, each of the first opposing edges having a first guide disposed therealong;

an elevator disposed on the tower and having a support, the elevator having second opposing edges each having a second guide, the support extending from the elevator outward from the front of the tower and configured to support a portion adjacent the one of the at least two opposing sides of the load, the second guides of the elevator configured to ride along the first guides of the tower, a first portion of the elevator configured to engage the front of the tower, a second portion of the elevator configured to engage the back of the tower; and an actuator comprising a strand jack disposed on the tower and having a strand of cables, the strand of cables extending vertically along the tower and connected to the elevator, the strand jack being configured to move the elevator vertically along the tower.

2. The system of claim 1, wherein at least one of the towers of the plurality of lifts comprises first and second adjacent rails having the first opposing edges, and wherein the first guides comprise surfaces defined along the first and second adjacent rails.

3. The system of claim 2, wherein the second guides of the elevator of the at least one tower comprise rollers disposed on the elevator, the rollers engaging the surfaces defined along the first and second adjacent rails.

4. The system of claim 3, wherein the rollers of the elevator of the at least one tower comprise:

side rollers disposed on the elevator and engaged with tracks defined along side ones of the surfaces of the first and second adjacent rails;

front rollers disposed on the first portion of the elevator and engaged with front ones of the surfaces of the first and second adjacent rails; and back rollers disposed on the second portion of the elevator and engaged with back ones of the surfaces of the first and second adjacent rails.

5. The system of claim 1, wherein the strand jack of at least one of the towers of the plurality of lifts comprises a hydraulic cylinder and a piston disposed between upper and lower clamps through which the strand passes.

6. The system of claim 1, wherein at least one of the towers of the plurality of lifts comprises a brace extending from the back of the at least one tower on a lateral extent of the base extending from the at least one tower away from the load.

7. The system of claim 1, further comprising a controller operably connected to each of the lifts, the controller configured to operate the lifts concurrently and independently.

8. The system of claim 1, further comprising a support beam arranged between the load and one or more of the lifts, wherein:

a first end of the support beam is engaged by a first of the lifts and a second end of the support beam is engaged by a second of the lifts, the support beam supporting one or more points of the load; or a first end of the support beam supports a first point of the load, a second end of the support beam supports a second point of the load, and an intermediate portion of the support beam is engaged by at least one of the lifts.

9. A system for lifting a heavy oversized load, the load having at least two opposing sides, wherein the system comprises:

at least two opposing lifts for placement adjacent the at least two opposing sides of the load, each of the lifts comprising:

a base;

a tower extending vertically from the base, the tower having a front and a back and having first opposing edges, each of the first opposing edges having a first guide disposed therealong, the tower having a plurality of steps disposed along the tower;

an elevator disposed on the tower and having a support, the elevator having second opposing edges each having a second guide, the support extending from the elevator outward from the front of the tower and configured to support a portion adjacent the one of the at least two opposing sides of the load, the second guides of the elevator configured to ride along the first guides of the tower, a first portion of the elevator configured to engage the front of the tower, a second portion of the elevator configured to engage the back of the tower; and an actuator comprising a push-pull jack disposed on the elevator and having upper and lower locks, the push-pull jack being configured to extend and retract the upper and lower locks relative to one another, the upper and lower locks being configured to engage and disengage the steps disposed along the tower, the push-pull jack and the upper and lower locks being configured to move the elevator vertically along the tower.

10. The system of claim 9, wherein at least one of the towers of the plurality of lifts comprises first and second adjacent rails having the first opposing edges, and wherein the first guides comprise surfaces defined along the first and second adjacent rails.

11. The system of claim 10, wherein the second guides of the elevator of at least one of the towers of the plurality of lifts comprise rollers disposed on the elevator, the rollers engaging the surfaces defined along the first and second adjacent rails.

12. The system of claim 11, wherein the rollers of the elevator of the at least one tower comprise:

side rollers disposed on the elevator and engaged with tracks defined along side ones of the surfaces of the first and second adjacent rails;

front rollers disposed on the first portion of the elevator and engaged with front ones of the surfaces of the first and second adjacent rails; and back rollers disposed on the second portion of the elevator and engaged with back ones of the surfaces of the first and second adjacent rails.

13. The system of claim 9, wherein the push-pull jack of at least one of the towers of the plurality of lifts comprises a hydraulic cylinder and a piston disposed between the upper and lower locks.

14. The system of claim 9, wherein at least one of the towers of the plurality of lifts comprises a brace extending from the back of the tower on a lateral extent of the base extending from the tower away from the load.

15. The system of claim 9, further comprising a controller operably connected to each of the lifts, the controller configured to operate the lifts concurrently and independently.

16. The system of claim 9, further comprising a support beam arranged between the load and one or more of the lifts, wherein:

a first end of the support beam is engaged by a first of the lifts and a second end of the support beam is engaged by a second of the lifts, the support beam supporting one or more points of the load; or a first end of the support beam supports a first point of the load, a second end of the support beam supports a second point of the load, and an intermediate portion of the support beam is engaged by at least one of the lifts.

17. A system for lifting a heavy oversized load having at least two opposing sides, the system comprising:

a plurality of lifts for arrangement along the at least two opposing sides of the load, each of the lifts comprising:

a base for placement adjacent one of the at least two opposing sides of the load;

a tower extending vertically from the base, the tower having a front and a back and having first opposing edges, each of the first opposing edges having a first guide disposed therealong;

an elevator disposed on the tower and having a support, the elevator having second opposing edges each having a second guide, the support extending from the elevator outward from the front of the tower and being configured to support a portion adjacent the one of the at least two opposing sides of the load, the second guides of the elevator being configured to ride along the first guides of the tower, a first portion of the elevator configured to engage the front of the tower, a second portion of the elevator configured to engage the back of the tower;

a strand of cables extending vertically along the tower between the first opposing edges; and a strand jack disposed on the elevator and configured to move the elevator vertically along the strand of cables.

18. The system of claim 17, further comprising a support beam arranged between the load and one or more of the lifts, wherein:

a first end of the support beam is engaged by a first of the lifts and a second end of the support beam is engaged by a second of the lifts, the support beam supporting one or more points of the load; or a first end of the support beam supports a first point of the load, a second end of the support beam supports a second point of the load, and an intermediate portion of the support beam is engaged by at least one of the lifts.

19. The system of claim 17, wherein at least one of the towers of the plurality of lifts comprises first and second adjacent rails having the first opposing edges, and wherein the first guides comprise surfaces defined along the first and second adjacent rails.

20. The system of claim 19, wherein the second guides of the elevator of the at least one tower comprise rollers disposed on the elevator, the rollers engaging the surfaces defined along the first and second adjacent rails.

21. The system of claim 20, wherein the rollers of the elevator of the at least one tower comprise:

side rollers disposed on the elevator and engaged with tracks defined along side ones of the surfaces of the first and second adjacent rails;

front rollers disposed on the first portion of the elevator and engaged with front ones of the surfaces of the first and second adjacent rails; and back rollers disposed on the second portion of the elevator and engaged with back ones of the surfaces of the first and second adjacent rails.

22. The system of claim 17, wherein the strand jack of at least one of the towers of the plurality of lifts comprises a hydraulic cylinder and a piston disposed between upper and lower clamps through which the strand passes.

23. The system of claim 17, wherein at least one of the towers of the plurality of lifts comprises a brace extending from the back of the at least one tower on a lateral extent of the base extending from the at least one tower away from the load.

24. The system of claim 17, further comprising a controller operably connected to each of the lifts, the controller configured to operate the lifts concurrently and independently.

* * * * *